US006881030B2

(12) United States Patent
Thut

(10) Patent No.: US 6,881,030 B2
(45) Date of Patent: Apr. 19, 2005

(54) IMPELLER FOR MOLTEN METAL PUMP WITH REDUCED CLOGGING

(76) Inventor: Bruno H. Thut, 16755 Park Circle Dr., Chagrin Falls, OH (US) 44023-4598

( * ) Notice: Subject to any disclaimer, the term of this patent is extended or adjusted under 35 U.S.C. 154(b) by 0 days.

(21) Appl. No.: 10/373,002

(22) Filed: Feb. 24, 2003

(65) Prior Publication Data

US 2004/0022632 A1 Feb. 5, 2004

Related U.S. Application Data

(62) Division of application No. 09/774,938, filed on Jan. 31, 2001, now Pat. No. 6,524,066.

(51) Int. Cl.[7] ..... F04D 7/06

(52) U.S. Cl. ..... 415/200; 415/206; 416/181

(58) Field of Search ..... 415/200, 206, 415/217.9, 110, 197, 170.1, 173.1; 416/179, 185, 181, 182, 241 B, 223 B

(56) References Cited

U.S. PATENT DOCUMENTS

| | | | | |
|---|---|---|---|---|
| 1,865,918 A | | 7/1932 | Junkers | |
| 2,472,412 A | | 6/1949 | Fritz | |
| 2,808,782 A | | 10/1957 | Thompson et al. | |
| 3,048,384 A | | 8/1962 | Sweeney et al. | |
| 3,291,473 A | | 12/1966 | Sweeney et al. | |
| 3,836,280 A | | 9/1974 | Koch | |
| 3,984,234 A | | 10/1976 | Claxton et al. | |
| 3,997,336 A | | 12/1976 | van Linden et al. | |
| 4,128,415 A | | 12/1978 | van Linden et al. | |
| 4,322,245 A | * | 3/1982 | Claxton | 75/684 |
| 4,351,514 A | | 9/1982 | Koch | |
| 4,426,068 A | | 1/1984 | Gimond et al. | |
| 4,456,424 A | | 6/1984 | Araoka | |
| 4,486,228 A | | 12/1984 | Ormesher | |
| 4,491,474 A | | 1/1985 | Ormesher | |
| 4,504,392 A | | 3/1985 | Groteke | |
| 4,518,424 A | | 5/1985 | Ormesher | |
| 4,743,428 A | | 5/1988 | McRae et al. | |
| 4,786,230 A | | 11/1988 | Thut | |
| 5,268,020 A | | 12/1993 | Claxton | |
| 5,540,550 A | | 7/1996 | Kubota | |
| 5,586,863 A | | 12/1996 | Gilbert et al. | |
| 5,597,289 A | | 1/1997 | Thut | |
| 5,622,481 A | | 4/1997 | Thut | |
| 5,634,770 A | | 6/1997 | Gilbert et al. | |
| 5,716,195 A | | 2/1998 | Thut | |
| 5,785,494 A | | 7/1998 | Vild et al. | |

(Continued)

OTHER PUBLICATIONS

Three pages containing Figs. 1–4 from U.S patent No. 6,019,576 showing pump and impeller sold more than one year before the filing date.

*Primary Examiner*—F. Daniel Lopez
*Assistant Examiner*—Kimya N. McCoy
(74) *Attorney, Agent, or Firm*—Pearne & Gordon LLP

(57) ABSTRACT

One aspect of the invention is directed to an impeller made of a non-metallic, heat resistant material, comprising a generally cylindrical shaped body, first and second generally planar end faces and a side wall extending between the first and second faces. A plurality of passages have inlets circumferentially spaced apart from each other on the first face, outlets at the impeller sidewall, and connecting portions extending between the inlets and the outlets transverse to the central axis. Another aspect of the invention is directed to an impeller comprising a central hub portion and first and second impeller bases, including end faces, transverse to a central axis. Vanes extend from the central hub portion between the impeller bases. Cavities are formed between the impeller bases and between adjacent vanes. Molten metal inlets on the end faces for molten metal to reach the cavities. Pumps are also disclosed using the inventive impellers.

20 Claims, 17 Drawing Sheets

U.S. PATENT DOCUMENTS 5,842,832 A 12/1998 Thut
5,951,243 A 9/1999 Cooper
6,019,576 A 2/2000 Thut
6,152,691 A 11/2000 Thut
6,254,340 B1 7/2001 Vild et al.
6,303,074 B1 10/2001 Cooper
6,464,458 B1 10/2002 Vild et al.
6,524,066 B1 * 2/2003 Thut ..... 415/200
2001/0028846 A1 10/2001 Vild et al.

* cited by examiner

IMPELLER FOR MOLTEN METAL PUMP WITH REDUCED CLOGGING

RELATED APPLICATIONS

The present application is a continuation-in-part application containing common subject matter with presently pending application Ser. No. 09/774,938, which was filed in the United States Patent and Trademark Office on Jan. 31, 2001, now U.S. Pat. No. 6,524,066.

FIELD OF THE INVENTION

This invention relates to impellers and to pumps for pumping molten metal which employ the impellers.

BACKGROUND OF THE INVENTION

Pumps used for pumping molten metal typically include a motor carried by a motor mount, a shaft connected to the motor at one end, and an impeller connected to the other end of the shaft. Such pumps may also include a base with an impeller chamber, the impeller being rotatable in the impeller chamber. Support members extend between the motor mount and the base and may include a shaft sleeve surrounding the shaft, support posts, and a tubular riser. An optional volute member may be employed in the impeller chamber Pumps are designed with shaft bearings, impeller bearings and with bearings in the base that surround these bearings to avoid damage of the shaft and impeller due to contact with the shaft sleeve or base. The shaft, impeller, and support members for such pumps are immersed in molten metals such as aluminum, magnesium, copper, iron and alloys thereof. The pump components that contact the molten metal are composed of a refractory material, for example, graphite or silicon carbide.

Pumps commonly used to pump molten metal may be a transfer pump having a top discharge or a circulation pump having a bottom discharge, as disclosed in the publication "H.T.S. Pump Equation for the Eighties" by High Temperature Systems, Inc., which is incorporated herein by reference in its entirety.

One problem that such pumps encounter is that they may be damaged by solid impurities contained in the molter metal including chunks of refractory brick and metal oxides (e.g. aluminum oxides). If a piece of hard refractory material becomes jammed in the impeller chamber it may destroy the impeller or shaft, and result in the expense of replacing these components. Chunks of refractory material such as brick with a higher specific gravity than the metal are typically disposed at the bottom of the vessel. Conversely, aluminum oxides with a lower specific gravity than the molten metal rise to the surface of the bath. Refractory material that has a specific gravity approximating that of the molten metal may be suspended in the bath. Refractory impurities in the molten metal are also a problem since, if not removed, they result in poor castings of the metal and potentially defective parts. Removing impurities from the molten metal bath is a hazardous process. A long steel paddle with an end that is in the shape of a perforated spoon is used to remove the impurities. To remove impurities with the paddle, workers need to come close to the molten metal at an area where temperatures may exceed 120 degrees Celsius. Although workers wear protective gear, they may be injured by splatters of metal. At the least, workers face a difficult task in removing the impurities, which they carry out in a two-step process, spooning the material upward from the bottom of the vessel and skimming the material from the surface. Each step typically lasts about 10–15 minutes. Removing the material from the bottom is carried out at least once a day and skimming is carried out at least once every eight hours. Removing impurities from the molten metal is a hazardous, costly, but necessary, process using traditional pump and impeller designs.

A second main design concern with a molten metal pump is clogging. Any impeller with an internal path for molten metal travel is susceptible to clogging, caused by solid pieces becoming lodged in the impeller and between the impeller and base. As mentioned, clogging can damage the impeller and generate expensive down-time and repairs. Some impeller designs attempt to solve this problem with specifically designed passages. A passage with an entrance less in diameter than the exit may help to reduce clogging, as alleged in U.S. Pat. No. 5,785,494 to Vild. Particles which are small enough to enter the entrance to the passage in theory pass easily through the exit of the passage.

A third main design concern with a molten metal pump is efficiency. The geometric design of a pump impeller primarily defines the fluid dynamic characteristics of the pump. The impellers of the U.S. Pat. No. 5,785,494 which have internal passages wherein the entrance diameter of each passage is less in diameter than the exit diameter, have a design which results in losses in pump efficiency and higher operating costs. Internal passages of such impellers are configured to permit travel along a direction of the pump axis and then in a radial direction. Despite reducing clogging, impellers of this design may suffer significant efficiency losses.

There is a need for an impeller and pump for pumping molten metal not prone to clogging which offer high efficiency operation, low maintenance cost, and safe operating conditions for personnel.

SUMMARY OF THE INVENTION

The present invention is directed to a pump for pumping molten metal with an impeller. One aspect of the invention utilizes an impeller comprising internal molten metal passages which are configured to increase the efficiency of the impeller. The travel of molten metal through the passages is at an angle to the central rotational axis of the impeller. The geometry of the passages further prevents clogging. The impeller may include optional stirrer passages which are configured and arranged to enable the impeller to cause solid matter in the molten metal to move toward an upper surface of the bath.

As defined herein, the term passage means a tunnel in which the flow of molten metal may be controlled so as to travel along a defined, relatively narrow path. Vanes are defined as discrete surfaces of an impeller, extending from near a lower portion of the impeller along its rotational axis to near an upper portion of the impeller, which do work to move molten metal when the impeller is rotated. Cavities are defined herein as the regions between adjacent vanes and have a height, which is much greater than the largest cross-sectional area of the impeller passages.

In general, the present invention is directed to pumps for pumping molten metal including a motor and a shaft having one end connected to the motor. An impeller is connected to the other end of the shaft which extends along a longitudinal axis, the impeller being constructed in accordance with the present invention. A base has a chamber in which the impeller is rotatable.

One embodiment of the present invention is directed to an impeller made of a non-metallic, heat resistant material comprising a body having a generally cylindrical shape. The impeller includes a central rotational axis, and first and second generally planar end faces extending transverse to the central axis. A side wall extends between the first and second faces. A plurality of passages have inlets circumferentially spaced apart from each other on the first face and outlets at the side wall. Connecting portions of the passages extend between the inlets and the outlets transverse to the central axis.

More specifically, each passage extends at an angle to the central axis along substantially its entire length and perimeter. Preferably, the side surface of each passage intersects the impeller sidewall at a downward angle relative to an axis extending radially from the central axis. The angles of each passage to the central axis are intended to provide the impeller with a high operating efficiency. The passages are preferably reverse pitched relative to a direction of rotation of the impeller.

The impeller may include stirrer passages in one of the faces circumferentially spaced apart from each other. The stirrer passages are configured and arranged to enable the impeller to cause solid matter in the molten metal to move toward an upper surface of the bath. Each stirrer passage extends at an angle to the central axis along substantially its entire length and perimeter. The stirrer passages in the cylindrical bodied impeller may be enlarged to have a cross-sectional area approximating that of the other passages. The stirrer passages thus function as infeed passages for the molten metal and the pump may be referred to as a top-and-bottom feed pump.

The sizes of the passages in the cylindrical body impeller may be varied. In a bottom feed pump, large passages (similar to the size of the passages now shown in the top face in FIG. 2) may have inlets in the bottom face of the impeller. In such pump, the upper face may have no passages, relatively small cross-sectional area stirrer passages or infeed passages having a size approximating that of the lower passages. Thus, the pump may be modified, by changing the size and location of the passages in the cylindrical body impeller, so as to be one of the following: top feed; bottom feed; top feed or bottom feed with stirrer passage inlets in the opposite end face; and top-and-bottom feed.

Another embodiment of the present invention is directed to a vaned impeller made of a non-metallic, heat resistant material. The impeller includes a generally cylindrical hub portion extending along a central rotational axis, and first and second bases spaced apart from one another along the central axis at opposing end portions of the impeller and extending transverse to the central axis. Vanes extend outwardly from the central hub portion between the first and second bases. Cavities of the impeller are each disposed between the first and second bases and between adjacent vanes. The impeller top end face (in the case of a top feed pump) includes a plurality of passages. The inlets of the passages are circumferentially spaced apart from each other in the first end face, and the passages terminate at the cavities of the impeller. The passages preferably extend from the top end face, through the first base portion and terminate at the cavities, all the while extending transverse to the central axis. The invention is also directed to a pump which employs this vaned impeller.

More specifically, each passage extends through the first impeller base at an angle to the central axis along substantially its entire length and perimeter. Further, each passage extends to the cavity at a downward angle relative to an axis extending radially from the central axis. The angles of each passage to the central axis are effective to provide the impeller with a high operating efficiency. The passages are preferably reverse pitched relative to a direction of rotation of the impeller.

A bearing member may be disposed around the impeller first end face and second end face. The first and second bases may be integrally formed with the body. Alternatively, the first and second bases may include a plate formed separately from the impeller and fastened to it. Each stirrer passage extends at an angle to the central axis along substantially its entire length and perimeter, and terminates in a cavity. The stirrer passages are configured and arranged to enable the impeller to cause solid matter in the molten metal to move toward an upper surface of the bath.

The vaned impeller of the invention is preferably formed so that the lower passages have a large size approximating that of the other (e.g., upper) passages. Thus, the passages in the top face and the passages in the bottom face act as infeed passages which enable molten metal to be drawn into the pump from below and above the base. This enables the pump which employs the vaned impeller to function as a top-and-bottom feed pump.

The sizes of the passages in the vaned impeller may be varied. In a bottom feed pump large passages (similar in size to the passages shown in the bottom face in FIG. 6) may have inlets in the bottom face of the impeller. In such pump the upper face may have no passages, relatively small cross-sectional area stirrer passages or infeed passages having a size approximating that of the lower passages. Thus, the pump may be modified, by changing the size and location of the passages in the vaned impeller, so as to be one of the following: top feed; bottom feed; top feed or bottom feed with stirrer passage inlets in the opposite end face; and top-and-bottom feed.

In an alternative embodiment, the impellers of the present invention may be constructed such that the inlet openings of the first end face, the inlet openings in the second end face and the connecting passages are all in alignment such that an axis extending from one of the inlet openings on the first end face through one of the connecting passages and through one of the inlet openings in the second end face and is generally parallel to the central axis. By aligning the inlet openings and the passages, a hole is created through the impeller. When debris clogs the impeller, a worker may take a rod and push it through the aligned hole to dislodge the clogged impeller. This in addition to other features of the invention allows the worker to maintain a safe distance from the molten metal in order to clear the impeller of any obstructions.

In the impeller where the passages extend at a downward angle relative to an axis extending radially from the central axis, the inlet openings may be designed to allow for the angular passages and still maintain alignment with the opposing inlet opening. For instance, the inlet opening in the first end face and second end face may be made larger or of different shape to allow the passages to be angular from the radial axis yet still creating a hole through the impeller to enable a rod to be used for clearing debris from the impeller body.

In another alternative embodiment, the impeller comprises a hub portion positioned along a rotational axis of the impeller and is centrally disposed between a first and second impeller base. The first and second impeller base each having an opening around the central axis. The impeller bases which include an outer face extend from the peripheral edge of the opening to the end portions of the impeller transverse to central axis thus appearing as a rings on the top and bottom outer circumference of the impeller. The impeller also has vanes that extend from the hub portion between the first impeller base and second impeller base where cavities are formed between the first and second base and adjacent to the vanes. A first and second internal wall section where the first internal section extends from the hub to the first impeller base, and the second internal section extends from the hub to the second impeller base. The first wall section includes a plurality of first inlets and the second wall section includes a plurality of second inlets. The first inlets create a passage from the first opening to the cavities and the second inlets create a passage from the second opening to the cavities to allow molten metal to enter the cavities for pumping action.

In another alternative embodiment, the first inlets extend from the hub to the outer face of the first impeller base and the second inlets extend from the hub to the second impeller base. In another embodiment, the first inlets extend from the hub to the first impeller base and the second inlets extend from the hub to the second impeller base. In yet another embodiment, the first inlets extend from the hub to the outer face of the first impeller base and the second inlets extend from the hub to the outer face of the second impeller base. In yet another embodiment, the first inlets extend from the hub to the first impeller base and said second inlets extend from the hub to the outer face of the second impeller base. The alternative designs allow molten metal to enter either the top or bottom or both faces of the impeller simultaneously.

In yet another embodiment, the hub portion and vanes extend from the internal edge of the second impeller base to the internal edge of the first impeller base along the rotational axis. A first internal vane section extends from the hub portion to the outer peripheral of the opening in the first impeller base and includes a plurality of inlets defined by the shape of the vanes and the peripheral edge of the opening. The first inlets communicating the first opening with the cavities. A second internal vane section extends from the hub portion to the outer peripheral of the opening and includes a plurality of second inlets defined by the shape of the vanes and the peripheral edge of the opening in the second impeller base. The second inlets communicating the second opening with the cavities.

The present invention presents advantages compared to typical pumps and impellers for pumping molten metal. Pumps for pumping molten metal are prone to clogging, which occurs when solid particles enter and lodge in the impeller between the impeller and base. Pumps in the prior art have attempted to address clogging with the use of internal passages having inlet diameters smaller in size than exit diameters, as in the case of the U.S. Pat. No. 5,785,494. Solid particles which are small enough to enter the entrance to the passage in theory pass through the larger exit of the passage. Nevertheless, it is believed use of the impeller of the U.S. Pat. No. 5,785,494 results in losses in pump efficiency and higher operating costs.

In contrast, one aspect of the present invention uses internal passages that permit molten metal travel at an angle to the central rotational axis along substantially the entire length and perimeter of the passage. Rotation of these passages imparts forces to the molten metal which improve the efficiency of the pump. Further, stirrer passages of the present invention, if used, may provide forces that act upon molten metal such as below the pump base in a top feed pump. Rotation of the stirrer passages is believed to enable particles, especially those suspended particles having approximately the specific gravity of the molten metal, to rise toward the surface of the bath. Therefore, when pumping molten metal according to the present invention, an improvement of pump efficiency, without clogging, is realized.

In addition, the vaned impeller of the invention moves molten metal differently than in the U.S. Pat. No. 5,785,494 in that it employs much shorter passages which are only in the upper and lower bases and which preferably extend at an angle to the central axis along substantially their entire length and periphery. In the vaned impeller of the present invention the passages terminate in the, much larger cavities formed between vanes of the impeller. The impeller relies on vanes to perform most of the work on the molten metal as do conventional vaned impellers, but utilizes the infeed or stirrer passages for straining to avoid clogging. In contrast, the U.S. Pat. No. 5,785,494 states that a vaned impeller is disadvantageous in that molten metal flow is difficult to control between adjacent vanes of the impeller. It is believed that the U.S. Pat. No. 5,785,494 design relies solely on passages or tunnels to perform work to move the molten metal and is disadvantageous in that the passages extend along the central axis and thus are believed to provide the impeller with lessened efficiency. Moreover, the impeller of the U.S. Pat. No. 5,785,494 employs a sidewall which is lacking in the inventive vaned impeller. The inventive vaned impeller enables a far greater volume of molten metal to be acted upon by its vanes than do the narrow passages of the U.S. Pat. No. 5,785,494.

The embodiments of the inventive impeller shown in FIGS. 26–36 have a number of advantages over prior art designs. For example, the impeller shown in FIGS. 29–31 can be machined as one piece on a CNC machine (later cementing the bearing rings) by cutting the central conical impeller vane sections and inlets from above and below and then cutting the cavities and vanes from the side. The impeller has a flexible design in which the size and number of inlets, cavities and vanes can be changed as desired to achieve maximum efficiency and strength. The impellers are unique in that they do not have passages from a top or bottom surface to a side wall. In fact, the impellers of FIGS. 26–36 have very short to non-existent passages, per se, but rather, are designed to communicate the central opening with the cavities between vanes via inlets. The impellers also do not employ a side wall. In one variation, rather than extending the vanes all the way to the outer circumference of the impeller as is conventional, the impeller may be strengthened by using shorter vanes (e.g., as shown in FIG. 27) in any of the embodiments herein. The above designs enable the inventive impellers to strain particles from entering the inlets, which approach the dual intakes at each end of the impeller, thereby minimizing jamming, while maximizing the flow rate and efficiency with which molten metal can be pumped due to the large volume of the cavities in the impeller and the shape of the vanes. This, combined with use of a volute opening in transfer pumps and even in the case of discharge pumps, is believed to provide the inventive impeller with improved performance compared to barrel-type impellers with their much lower internal volume and small passages traveling from barrel end to barrel side-wall and resultant lower flow rates and efficiency.

Many additional features, advantages and a fuller understanding of the invention will be had from the accompanying drawings and the detailed description that follows. It should be understood that the above Summary of the Invention describes the invention in broad terms while the following Detailed Description describes the invention more narrowly and presents specific embodiments which should not be construed as necessary limitations of the broad invention as defined in the claims.

DETAILED DESCRIPTION

Figure 1:
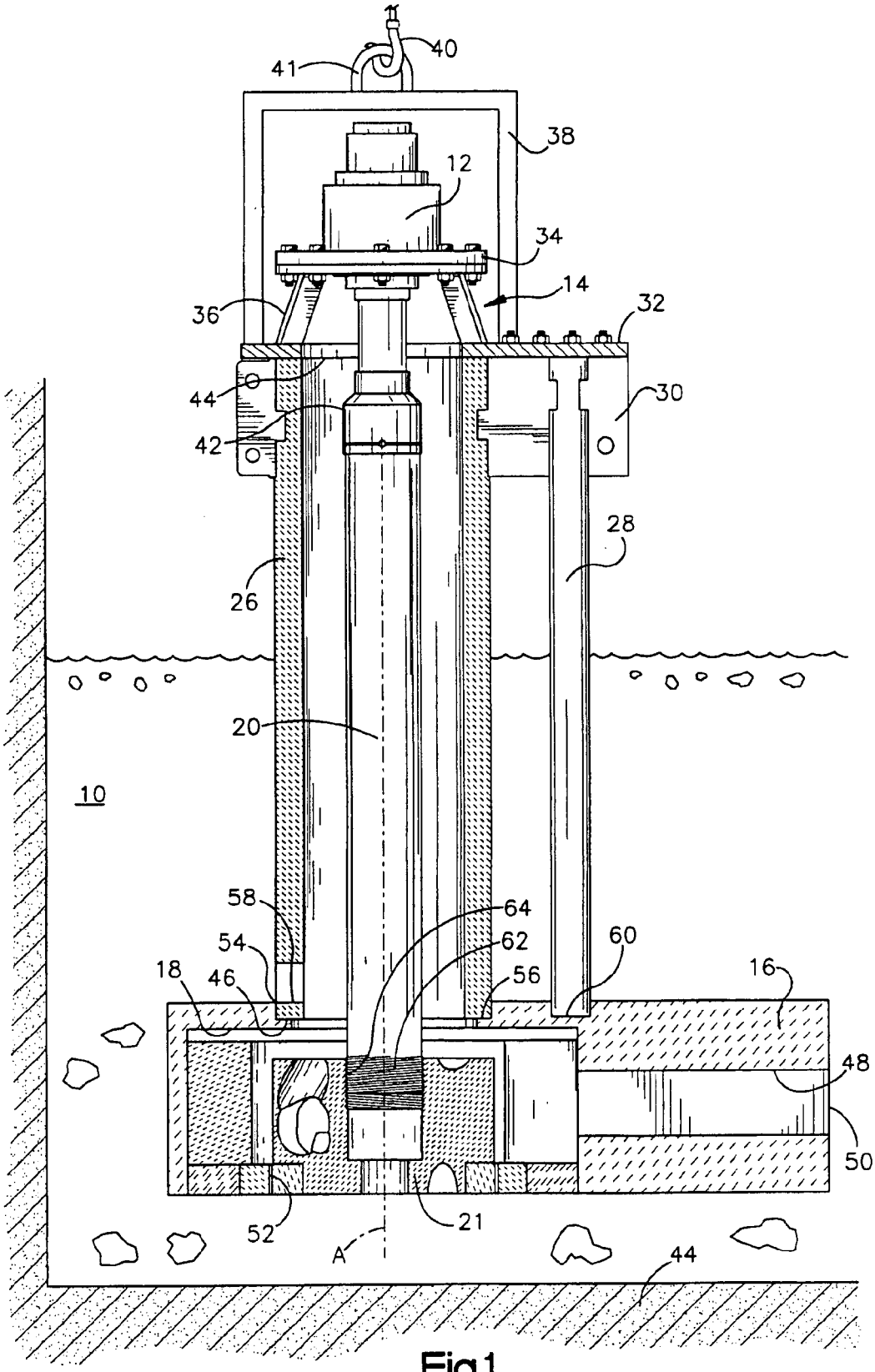
FIG. 1 is a vertical cross-sectional view of a pump constructed in accordance with the present invention.
Figure 2:
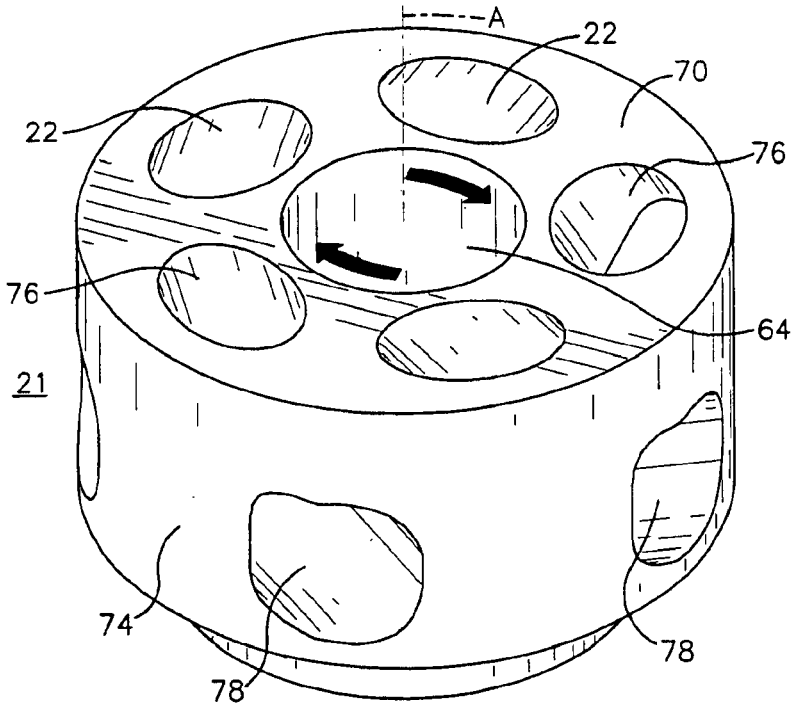
FIG. 2 is a perspective view of the impeller shown in FIG. 1.

Referring to FIGS. 1 and 2, the illustrated pump is a top feed discharge pump generally designated by reference numeral 10. The pump includes a motor 12 mounted to a motor mount 14. A base 16 has an impeller chamber 18 formed therein, the impeller chamber being defined herein as an interior chamber of the base which receives the impeller. A shaft 20 is connected to the motor 12 at one end. An impeller 21 is connected to the other end of the shaft 20 and is rotatable in the impeller chamber 18. The impeller includes a plurality of passages 22, shown in FIG. 2. These passages, in view of a unique design, provide the impeller with a high operating efficiency, while providing a straining action that prevents internal impeller clogging due to solid matter in the molten metal. The impeller also includes optional stirrer passages 24 in the base, shown in FIGS. 3–5. The stirrer passages are similar to the stirrer passages discussed in the U.S. Pat. No. 6,019,576 to Thut, which is incorporated herein by reference in its entirety. The stirrer passages are designed to enable the impeller to exert forces on the molten metal to facilitate removal of solid matter in the molten metal. The molten metal is any known in the industry, for example, aluminum or alloys thereof. The terms solid matter used herein refer to refractory material comprising refractory brick and metal oxide particles (e.g., aluminum oxide), as well as foreign objects.

A shaft sleeve 26 optionally surrounds the shaft 20. The shaft sleeve 26 and an at least one optional support post 28 are disposed between the motor mount 14 and the base 16. The shaft sleeve 26 and the support post 28 have their lower ends fixed to the base 16. A quick release clamp 30 is carried by the motor mount 14. The quick release clamp is of the type described in U.S. Pat. No. 5,716,195 to Thut, entitled "Pumps for Pumping Molten Metal," issued Feb. 10, 1998, which is incorporated herein by reference in its entirety. The clamp 30 releasably clamps upper end portions of the shaft sleeve 26 and the support post 28, for example. Individual clamps around the upper ends of each support member (e.g., posts, shaft sleeve and riser) may also be employed. The motor mount may be pivotably mounted, as disclosed in U.S. Pat. No. 5,842,832 to Thut, entitled "A Pump for Pumping Molten Metal Having Cleaning and Repair Features," issued Dec. 1, 1998, which is incorporated herein by reference in its entirety.

It should be apparent that the invention is not limited to any particular pump construction, but rather may be used with or form a component of any construction of transfer or circulation pump. Further, the present invention would suitably perform as a bottom feed pump. Those skilled in the art would appreciate that in a bottom feed pump, the impeller shown in FIG. 1, for example, would be inverted and the pump base constructed so as to include a recess which supports a bearing ring that is aligned with the upper bearing ring of the impeller of the bottom feed pump and that the threaded opening would be disposed at the upper end of the impeller (now shown as the lower end in FIG. 1). More than one of the inventive impellers described herein may be used, such as in a dual volute impeller pump of the type described by U.S. Pat. No. 4,786,230 to Thut.

The motor mount 14 comprises a flat mounting plate 32 including a motor support portion 34 supported by legs 36. A hanger 38 may be attached to the motor mount 14. A hook 40 on the end of a cable or the like is inserted into an eye 41 on the hanger to hoist the pump 10 into and out of the vessel or furnace. Various types of hangers are suitable for use in the present invention, for example, those disclosed in the publication "H.T.S. Pump Equation for the Eighties" by High Temperature Systems, Inc. The motor 12 is an air motor or the like, and is directly mounted onto the motor support portion 34.

The shaft 20 is connected to the motor 12 by a coupling assembly 42 which is preferably constructed in the manner shown in U.S. Pat. No. 5,622,481 to Thut, issued Apr. 22, 1997, entitled "Shaft Coupling For A Molten Metal Pump", which is incorporated herein by reference in its entirety. An opening 44 in the mounting plate 32 permits connecting the motor 12 to the shaft 20 with the coupling assembly 42.

Figure 14:
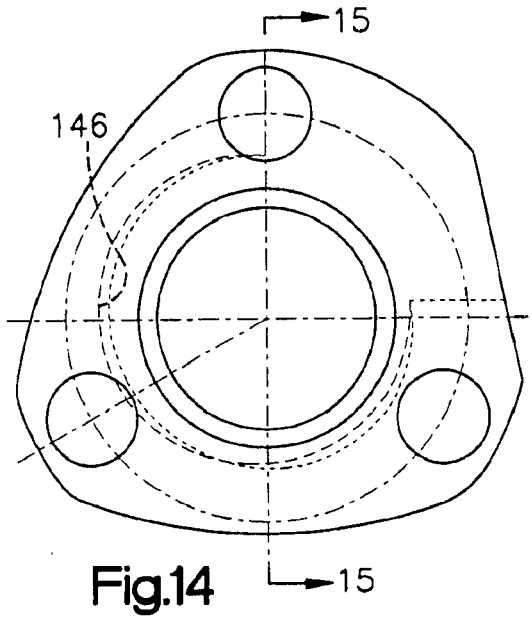
FIG. 14 is a top plan view of the base shown in FIG. 13.
Figure 15:
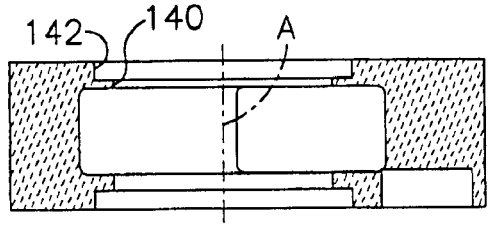
FIG. 15 is a vertical cross-sectional view as seen from the plane designated 15—15 in FIG. 14.
Figure 16:
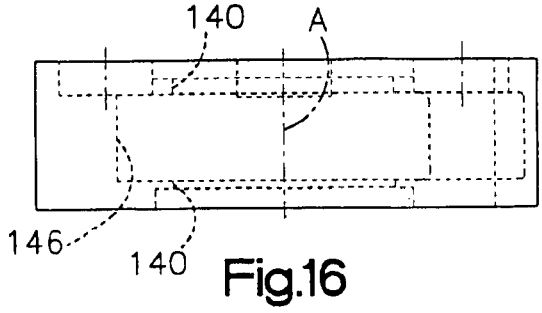
FIG. 16 is a side elevational view of the base shown in FIG. 14.

The base 16 is spaced upward from the bottom of vessel 44 by a few inches or more and has a molten metal inlet opening 46 leading to the impeller chamber 18 and a discharge passage 48 leading to an outlet opening 50. The discharge passage is preferably tangential to the impeller chamber as seen in a top view, as is known in the art (see, e.g., FIGS. 14, 17). An opening 52 is formed in a lower surface of the base and receives the impeller 21. An opening 54 surrounds the base inlet opening 46 and receives the shaft sleeve 26, openings 52 and 54 being concentric to one another relative to the central axis A of the impeller. A shoulder 56 is formed in the base 16 around the inlet opening 46, and supports the shaft sleeve 26. The shaft sleeve 26 is cemented in place on the shoulder 56. The shaft sleeve 26 contains multiple inlet openings 58 adjacent the base 16 (one of which is shown). The post 28 is cemented in place in an opening 60 in the base.

Other pump base and volute configurations may be employed in the present invention such as that disclosed in U.S. Pat. No. 6,152,691, which is incorporated herein by reference in its entirety. The impeller 21 may be used in the pump shown in FIG. 13, if modified to include an upper recess and bearing ring, similar to the impeller shown in FIG. 6.

The impeller 21 is attached to one end portion of the shaft 20 such as by engagement of exterior threads 62 formed on the shaft 20 with corresponding interior threads 64 formed in the impeller 21. However, any connection between the shaft 20 and the impeller 21, such as a key way or pin arrangement, or the like, may be used.

In one embodiment shown in FIGS. 2–5, the impeller 21 has a generally cylindrically shaped body which includes a central rotational axis A, and first and second generally planar end faces 70, 72 extending transverse to the central axis. The impeller is made of a non-metallic, heat resistant material, such as graphite and/or ceramic, suitable for operating in molten metal. The first face is a top face and the second face is a bottom face in a preferred embodiment. A side wall 74 extends generally parallel to the central axis between the first and second faces and forms a perforated circumferential surface. A plurality of passages 22 have inlets 76 circumferentially spaced apart from each other on the first face 70. The preferred number of passages is five, but the number may vary as would be apparent to one skilled in the art in view of this disclosure. The impellers disclosed throughout this disclosure may be designed to vary the number and/or size of passages to achieve different flow rates with the pump (SCFM). That is, using more passages or increasing their areas results in greater flow rate of the pump. Therefore, for example, for a greater flow rate an impeller with five passages could be replaced with one having seven passages. The passages have outlets 78 at the side wall 74. Connecting portions 79 extend between the inlets 76 and the outlets 78 and form passages for molten metal travel.

Figure 4:
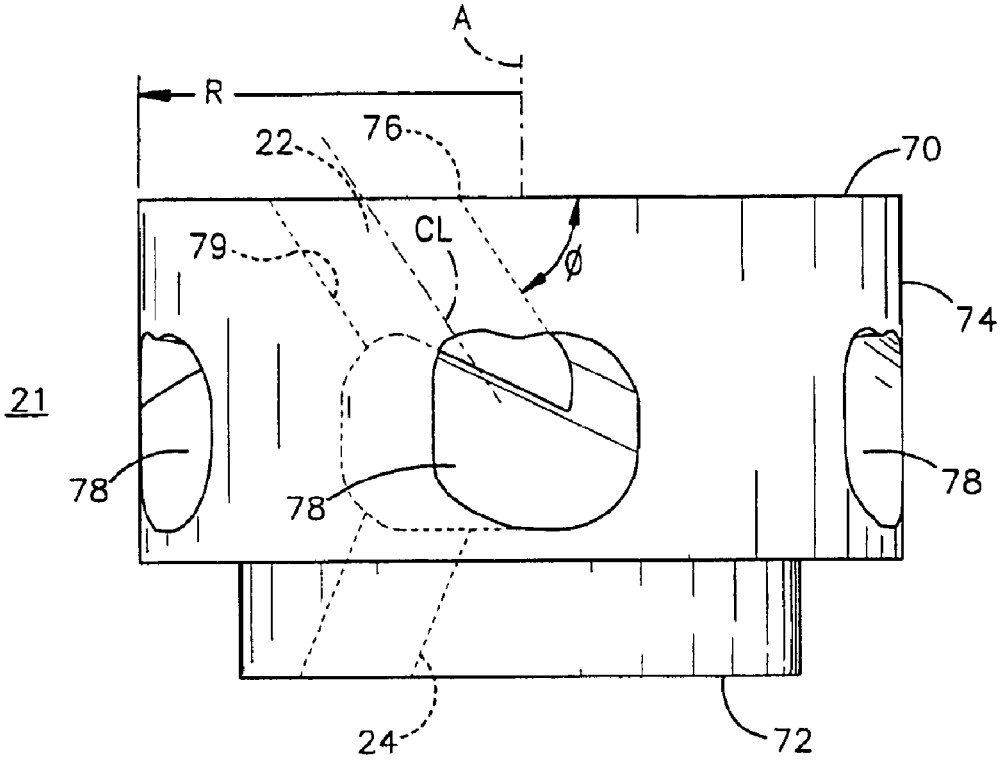
FIG. 4 is a side elevational view of the impeller shown in FIG. 2.
Figure 5:
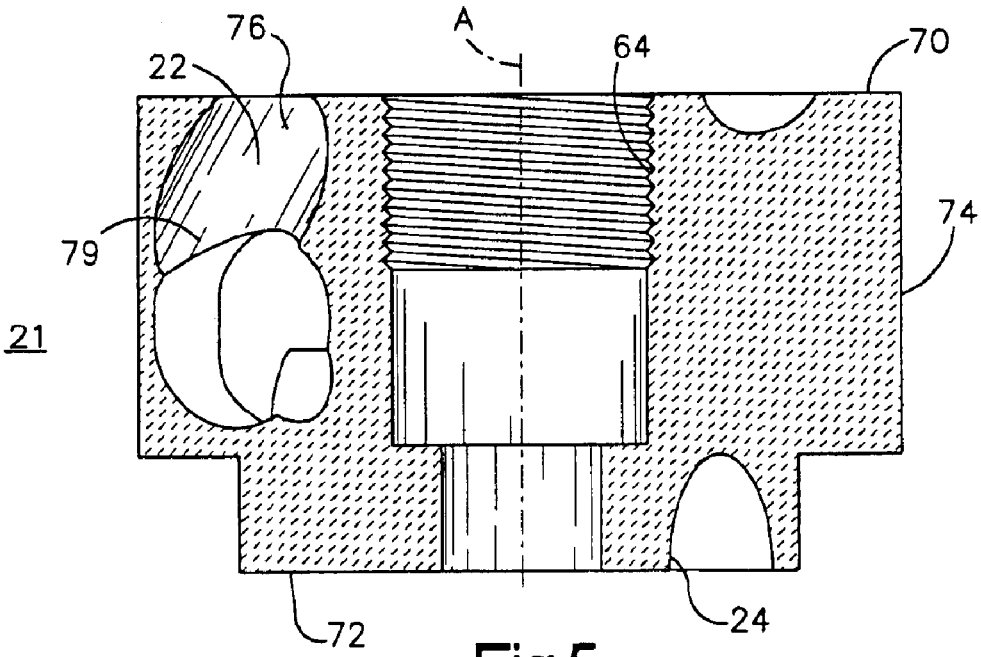
FIG. 5 is a vertical cross-sectional view of the impeller shown in FIG. 2.

The passages 22 extend transverse to and at an angle to the central axis A along substantially their entire length and perimeter, as shown in FIG. 4. No part of the passages extends parallel to the axis A. Further, the passages 22 extend to the side wall at a downward angle Ø relative to an axis R extending radially from the central axis A (or an end face). The acute angle Ø relative to the axis R as shown in FIG. 4 may range from 30° to 75° and is preferably about 45°, although the angle may vary based upon the height and diameter of the impeller, cross-sectional area of the passages and passage spacing. Those skilled in the art will be able to determine the range of angles for a particular design in view of this disclosure.

The design of the passages 22 so as to extend at an angle to the central axis A (FIG. 4) is intended to provide the impeller with a higher operating efficiency, compared to the impeller of the U.S. Pat. No. 5,785,494 which includes a passageway component extending parallel to the central axis. Further, the diameter of the inlet 76 is preferably not larger in size than the diameter of the outlet 78. These relative sizes are preferred to prevent clogging. Any piece of solid matter that enters the inlet should pass through the passage and exit the outlet. The passages 22 preferably extend along a generally straight centerline throughout their length (see FIG. 4, centerline CL). Internal impeller passages in the prior art, such as disclosed in U.S. Pat. No. 5,785,494 to Vild, have large sections of curved passageways and non-angular passageways, as well as portions extending parallel to the rotational axis. It is believed that efficiency losses result from this type of construction.

A mounting hole with the internal threads 64 is centered on the central axis of the impeller top face 70. The threads 64 engage the external threads 62 of the pump shaft 20 as shown in FIG. 1.

The impeller may include stirrer passages 24 similar to those disclosed in U.S. Pat. No. 6,019,576 to Thut. In FIG. 4, it can be seen that the stirrer passages 24 communicate with the passages 22 and lead to a common exit 78. The common exit 78 may increase the stirring forces on the bath of molten metal. The over-sized cross-sectional area of the common exit 78 relative to the inlets 76 is further advantageous to prevent clogging.

If used, the number of stirrer passages 24 in the base is preferably five. However, it will be appreciated by those skilled in the art in view of this disclosure that the number and location of stirrer passages 24 may vary. In this and in the other vaned impeller of the invention, the number, size and arrangement of the stirrer passages 24 should be selected to provide stirring action while preferably not substantially reducing pumping efficiency and/or substantially adversely affecting the balance of the impeller.

Figure 3:
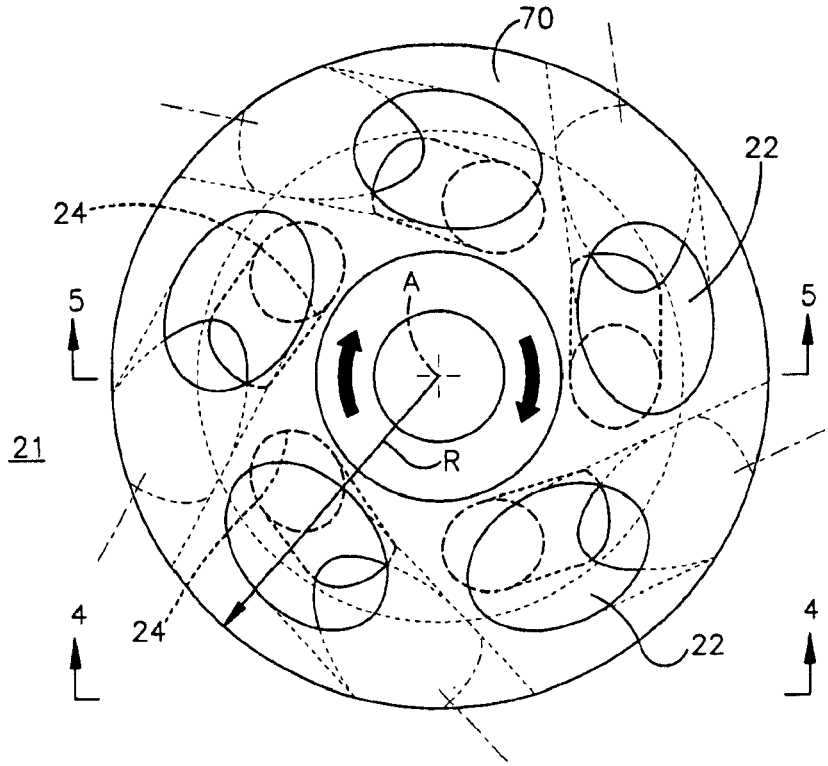
FIG. 3 is a top plan view of the impeller shown in FIG. 2.

The impeller shown in FIGS. 2–5 is rotated in a clockwise direction when viewed from above in a top feed pump. The passages of the impeller extend at a pitch, i.e., not radially from the central hub. In a top feed pump, the passages 22 preferably have a reverse pitch with respect to the direction of rotation (FIG. 3). Forward pitch is defined by a travel path of the passages of FIGS. 1–5 or passages shown in FIG. 6 starting at an end face and moving into the impeller in the same direction as rotation, whereas reverse pitch is defined by a travel path of the passages of FIGS. 1–5 or passages shown in FIG. 6 starting at an end face and moving into the impeller away from or opposite to the direction of rotation. The pitch of the stirrer passages 24 is preferably a mirror image of the upper passages. In other words, as shown in FIGS. 2 and 3, the direction of rotation of the impeller is counterclockwise when viewed from below, and the passages 24 are reversed pitched relative to this rotation. The pitch of the passages 24 is believed to stir up solid matter in the molten metal and cause the solid matter, especially on or near the bottom of the vessel, to move toward the upper surface of the bath where it may be removed by skimming.

It should be appreciated that the impeller 21 could be designed so that the passages 24 are much larger, for example, as large as the passages 22 or even larger. Such passages are then more appropriately referred to as infeed passages as the impeller would draw molten metal from the passages 22 and the passages 24. Also, the impeller 21 may be designed to have an upper annular recess and to include bearing rings disposed in the upper and lower recesses and cemented in place. The base would carry corresponding bearing rings in alignment with the impeller bearing rings (e.g., in the manner of FIG. 18).

In a bottom feed pump, a pitch of an inlet located at the bottom of the base may be defined with respect to rotation of the bottom end face. In an impeller for a bottom feed pump, the pitch of the inlet passages of a bottom end face is reverse pitch with respect to the counterclockwise rotation seen by the bottom end face, while the pitch of the passages of the top end face is reverse pitched with respect to the clockwise rotation seen by the top face. The pitch requirements discussed above also apply to the impeller shown in FIG. 6. Those skilled in the art will appreciate in view of this disclosure that the impeller may rotate counterclockwise with the attendant changes to the design of the impeller and its passages.

Figure 10:
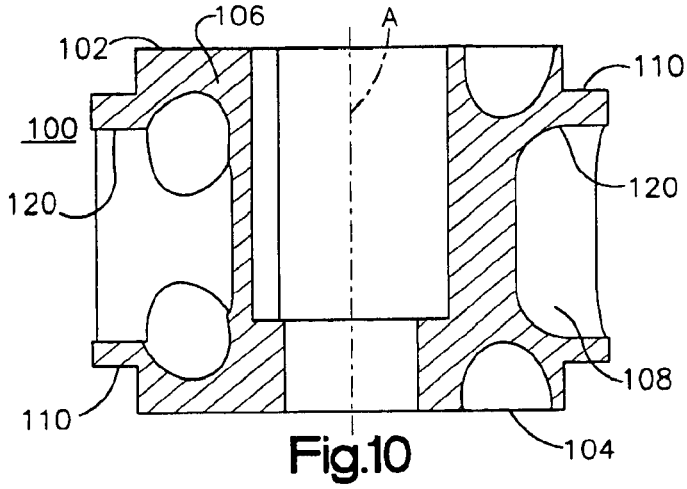
FIG. 10 is a vertical cross-sectional view as seen along the plane designated 10—10 in FIG. 9.
Figure 11:
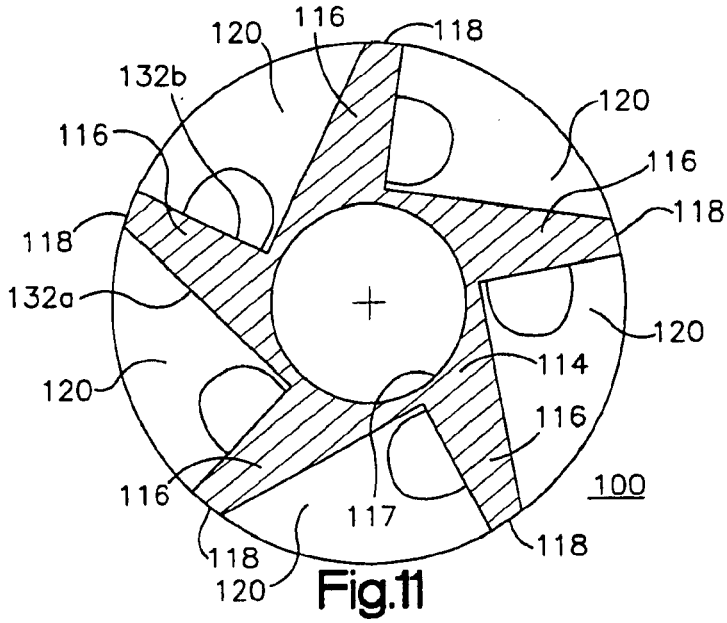
FIG. 11 is a cross-sectional view as seen from the plane designated 11—11 in FIG. 8.
Figure 12:
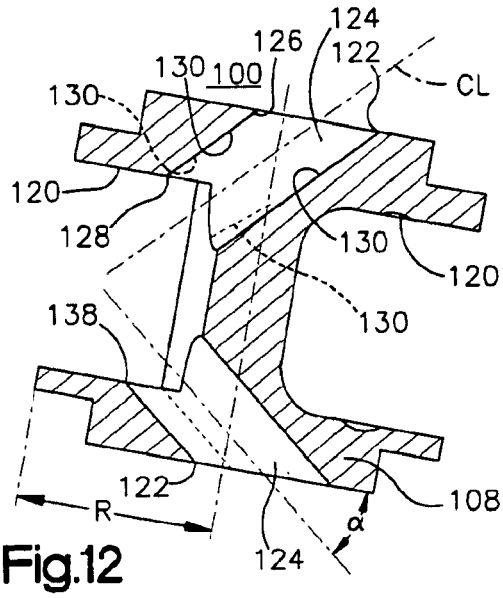
FIG. 12 is a cross-sectional view as seen from the plane designated 12—12 in FIG. 9.

A different vaned impeller 100 is shown in FIGS. 6–12 and is characterized by having no sidewall as contrasted with the impeller 21. The impeller is made of a non-metallic, heat resistant material, such as graphite and/or ceramic, suitable for operating in molten metal. The impeller includes a central rotational axis A, and first and second 102, 104 generally planar end faces extending transverse to the central axis A (FIG. 10). The first end face 102 is formed by the top surface of an upper base 106 of the impeller while the second end face 104 is formed by the bottom surface of a lower base 108 of the impeller (FIG. 12). As shown, formed in the upper and lower impeller bases are annular recesses 110, each of which receives an annular bearing member 112 attached to the impeller body, which is formed of a bearing material such as a ceramic material and cemented in place.

Figure 6:
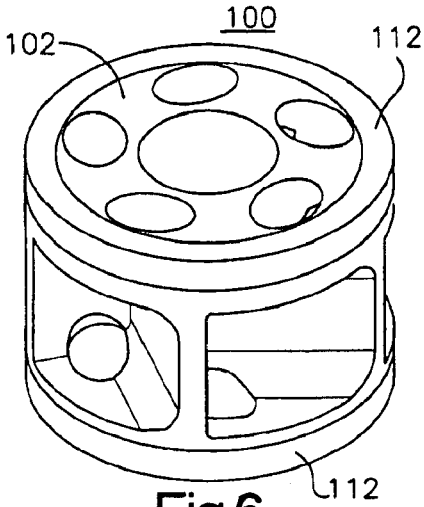
FIGS. 6 and 7 are perspective views of a vaned impeller constructed according to the invention, showing the upper and lower surfaces, respectively.
Figure 7:
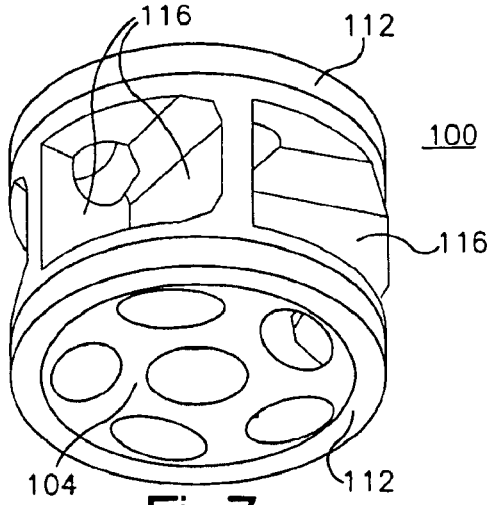
Figure 8:
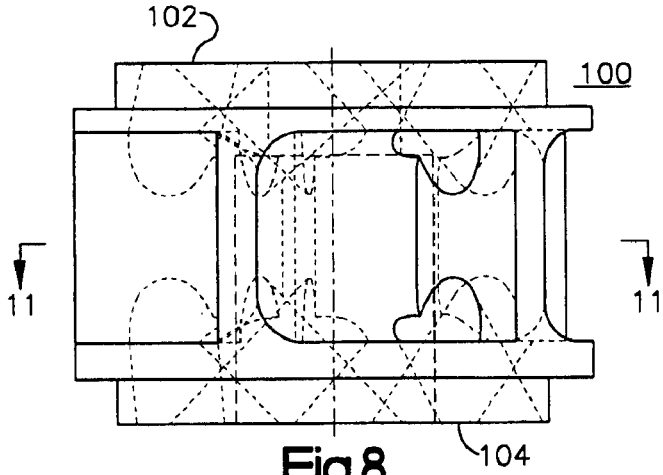
FIG. 8 is a front elevational view of the impeller of FIG. 6.
Figure 9:
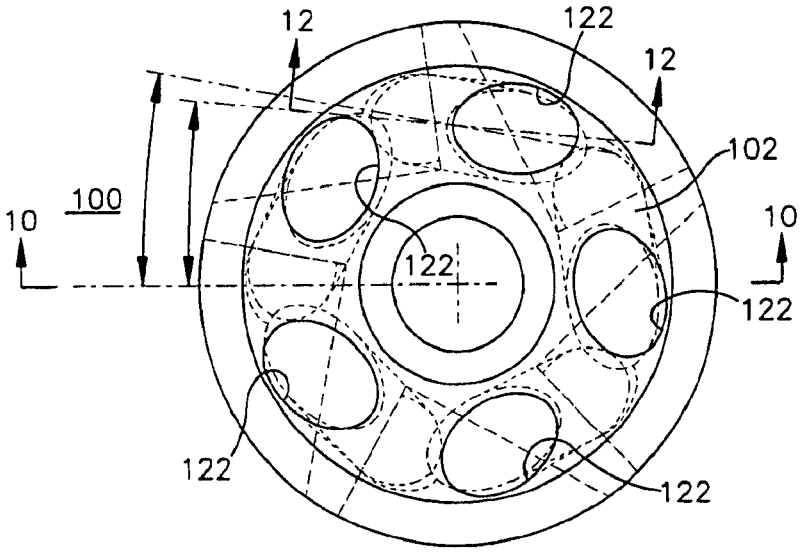
FIG. 9 is a top plan view of the impeller of FIG. 8.

Agenerally cylindrical central hub portion 114 (FIG. 11) extends between and connects the upper base 106 to the lower base 108 along the rotational axis A. Use of the hub portion is preferred and provides the impeller with desired strength. Preferably five vanes 116 extend outwardly from the hub portion 114, to the outer peripheral surface 118 of the vanes. Using five vanes is believed to overcome vibration problems, as described in U.S. Pat. No. 5,597,289 to Thut, entitled "A Dynamically Balanced Pump Impeller," which is incorporated herein by reference in its entirety. However, other numbers of vanes may be suitable for use in the present invention. The vanes also extend from the upper surface of the lower base generally in a direction along axis A to the lower surface of the upper base. Cavities 120 are disposed between each pair of adjacent vanes 116, between the upper and lower impeller bases. A plurality of molten metal inlets 122 are circumferentially spaced apart from one another in the upper and lower end faces. The inlets in the upper and lower end faces form a part of passages 124 which lead to the cavities 120. With respect to the upper passages 124, for example (FIG. 12), the molten metal enters the inlets at an entrance point 126 in the upper base and leaves the upper base at an exit point 128 where it enters a cavity 120. In FIG. 6 five passages are shown. The preferred number of passages is five, but it should be understood to those practicing the art, that other numbers of passages could be used. The molten metal travel path from entrance 126 to exit 128 is inclined all the while and preferably extends throughout the base 106 along a generally straight line path (along centerline CL, FIG. 12). No portion of the passage extends along the axis A. It should be understood to those practicing the art, that other travel paths may be followed, such as the path of the multi-angled passage 130 shown by dotted lines in FIG. 12. The travel path within the passages is at an angle to the central axis along substantially its entire length and perimeter. The angle of the passages is defined between a radius R (or an end face) and a line parallel to a side wall of the passages 124 as shown by $\alpha$ in FIG. 12, which ranges from about 30 to about 75° and is preferably about 45°, although the angle may vary based upon the height and diameter of the impeller, cross-sectional area of the passages and passage spacing. The angle of the passages is intended to provide the impeller with a high operating efficiency.

As best shown in FIG. 11, the vanes preferably extend substantially tangentially from the hub portion. The vanes preferably are generally straight rather than curved. That is, a straight line can be drawn completely within a body of a vane for its entire length from the central opening 117 to the outer peripheral surface 118 of the vanes. Each vane has two side surfaces 132*a*, 132*b* that extend in a direction from the hub portion to the vane end portion 118 and in a direction along the rotational axis A between the upper and lower bases of the impeller.

The side surface of each vane is spaced apart from a side surface of an adjacent vane, with a cavity disposed therebetween, entirely along directions parallel to and transverse to the axis A between the upper and lower impeller bases. The impeller has no sidewall and no passages extending to a sidewall, in contrast to the U.S. Pat. No. 5,785,494 impeller. The U.S. Pat. No. 5,785,494 impeller employs a volume of solid material greatly exceeding a volume of passageways, whereas the present impeller has a relatively large volume of cavities which may reduce the opportunity for clogging compared to the U.S. Pat. No. 5,785,494 impeller.

The upper and lower bases are preferably integrally formed with the central hub portion and vanes but may be formed by plates that are cemented or suitably fastened to the top and bottom surfaces of the impeller vanes and central hub.

The mounting hole 117 has internal threads and is centered on the axis A of the impeller. The threads engage external threads of the pump shaft in a known manner.

The infeed passages 124 terminate at the cavities 120. The number of infeed passages is preferably five, with one passage being located between adjacent vanes. However, it will be appreciated by those skilled in the art in view of this disclosure that the number and location of the infeed passages in the impeller bases may vary.

The vaned impeller 100 is designed to facilitate simultaneous drawing of molten metal from the top and bottom of the impeller. In this respect the pump in which it is employed may be referred to as a top-and-bottom feed pump. The passages of the impeller are shown having approximately equal cross-sectional area as one another. However, their size may be varied to control the relative volumes of molten metal designed to be drawn into the pump from the top and bottom. Thus, with larger, cross-sectional area upper passages, the pump could operate as primarily top feed with lower stirrer passages if the cross-sectional area of the lower passages is substantially less as shown at 138 by the lower solid line and upper dotted line in FIG. 12; and, with larger cross-sectional area bottom passages than top passages, the pump may function as primarily bottom feed with optional upper stirrer passages. The inventive vaned impeller advantageously avoids jamming.

Thus, if a base is designed so as to include two impellers 100 stacked on one another as disclosed in the U.S. Pat. No. 4,786,230, molten metal may be directed in different locations by each impeller, which is facilitated by designing the passages to infeed from an intended portion of the base, top or bottom. Also, the relative pumping pressure caused by each impeller may be varied by the size and/or number of the passages.

Figure 13:
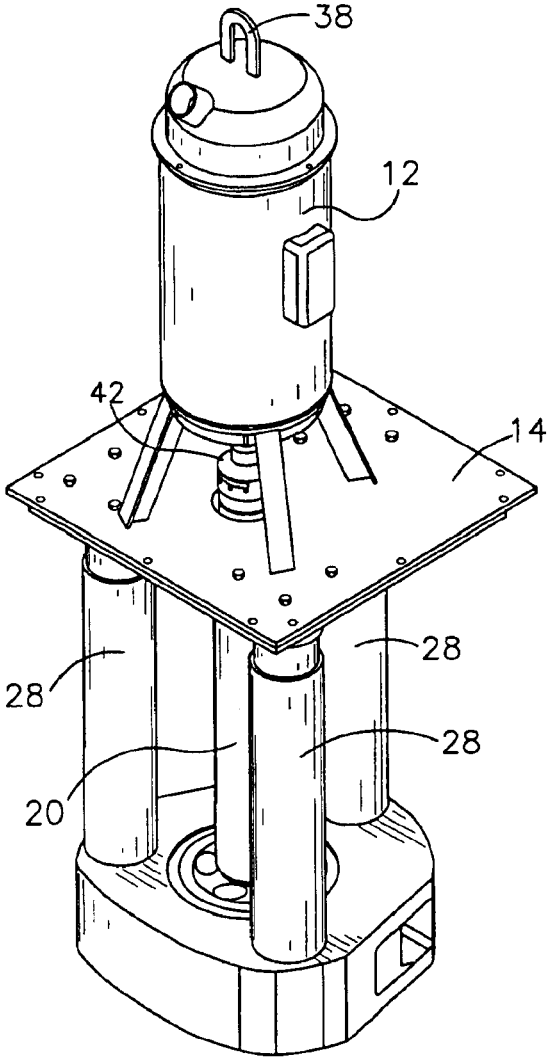
FIG. 13 is a perspective view of a pump constructed according to the present invention which employs the impeller of FIGS. 6–12.

Moreover, the impeller may be used in a pump base, which employs a volute opening as shown in FIG. 13. The infeed passages in the top and bottom faces of the impeller act as strainer passages to prevent clogging. A volute opening may be used in the present invention to provide the increased pumping pressure required for transfer pumping applications, while not suffering from clogging problems to which volute type pumps may-be subject. In addition, even when used in circulation applications, a volute may be used with the inventive impellers since the instances of clogging are reduced and the pump may benefit from the greater pumping pressure achieved with the use of the volute.

The pump that is shown in FIG. 13 is a top-and-bottom feed circulation pump. Like numerals are used to designate like parts throughout the several views of this application. This pump does not include a shaft sleeve. The base is fabricated using a CNC machine to form the concentric openings 140 in upper and lower surfaces of the base relative to rotational axis A and surrounding recesses 142 in which bearing rings are cemented in place. The spiral shaped volute opening 146 is also formed in the base with the CNC machine, which avoids attaching parts to the base such as a volute member and lower plate, as was the conventional practice.

Figure 17:
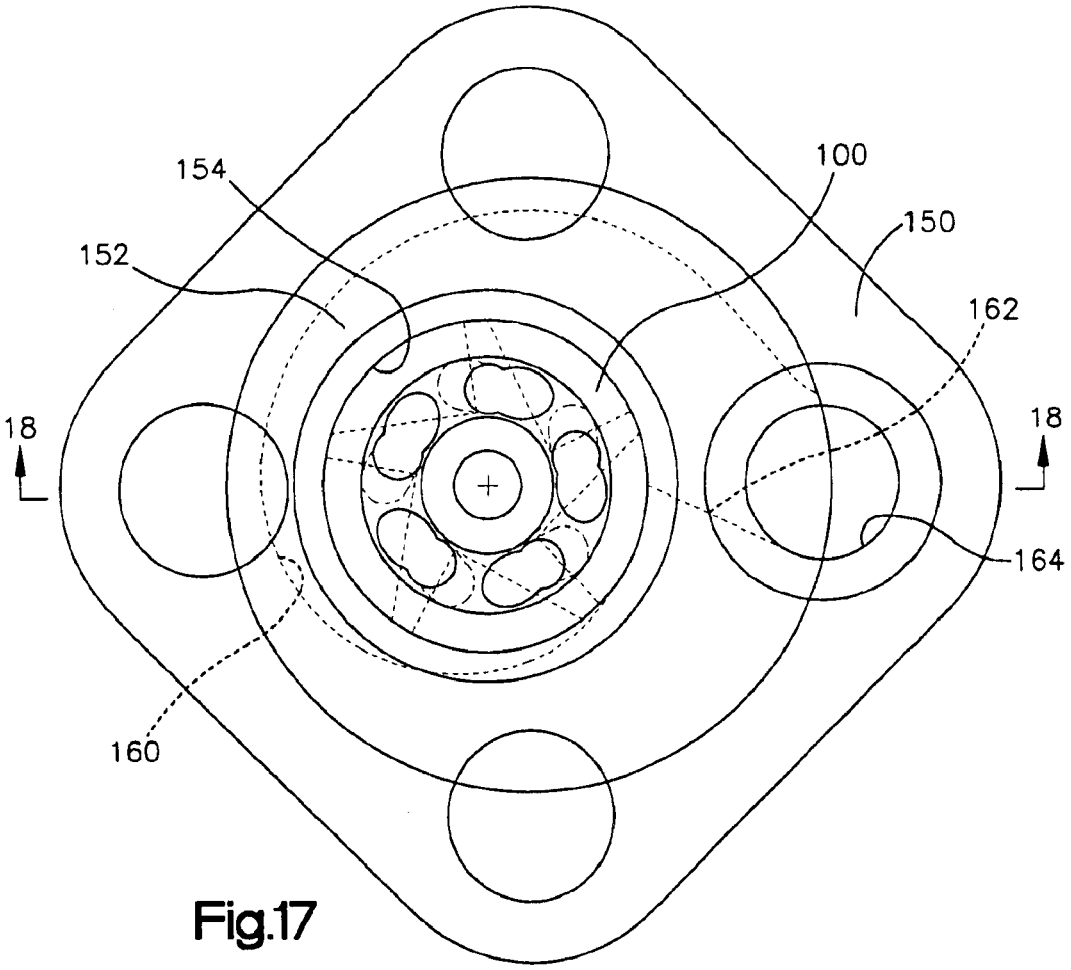
FIG. 17 is a top plan view of a base which employs an impeller of the type shown in FIGS. 6–12.
Figure 18:
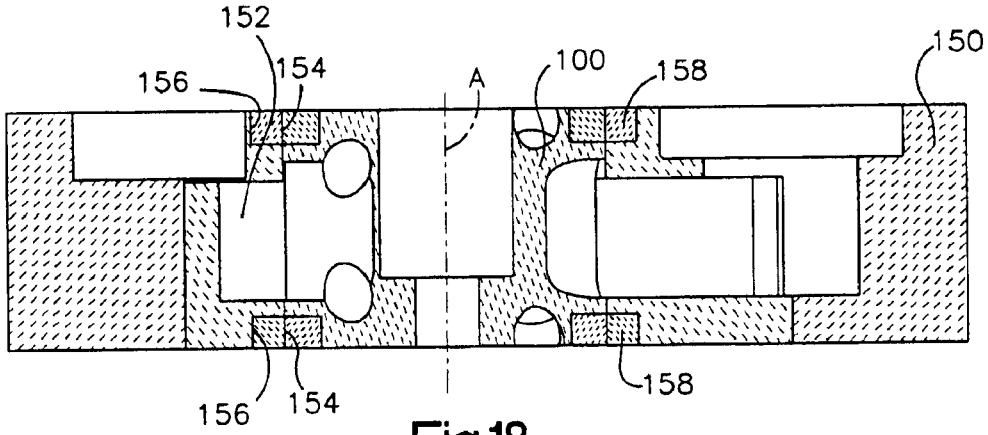
FIG. 18 is a vertical cross-sectional view of a base of FIG. 17.
Figure 19:
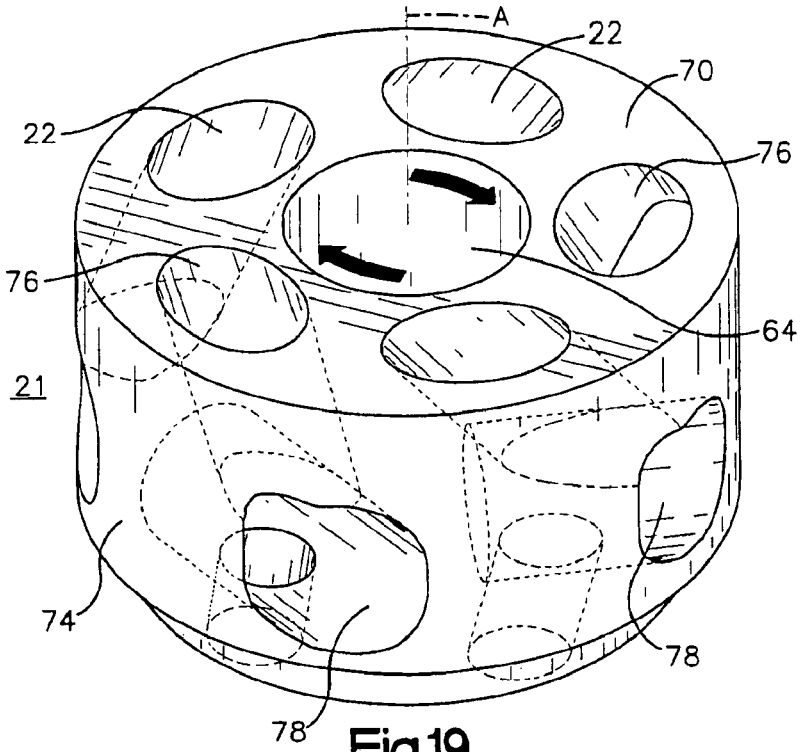
FIG. 19 is a perspective view of an impeller according to the present invention.
Figure 20:
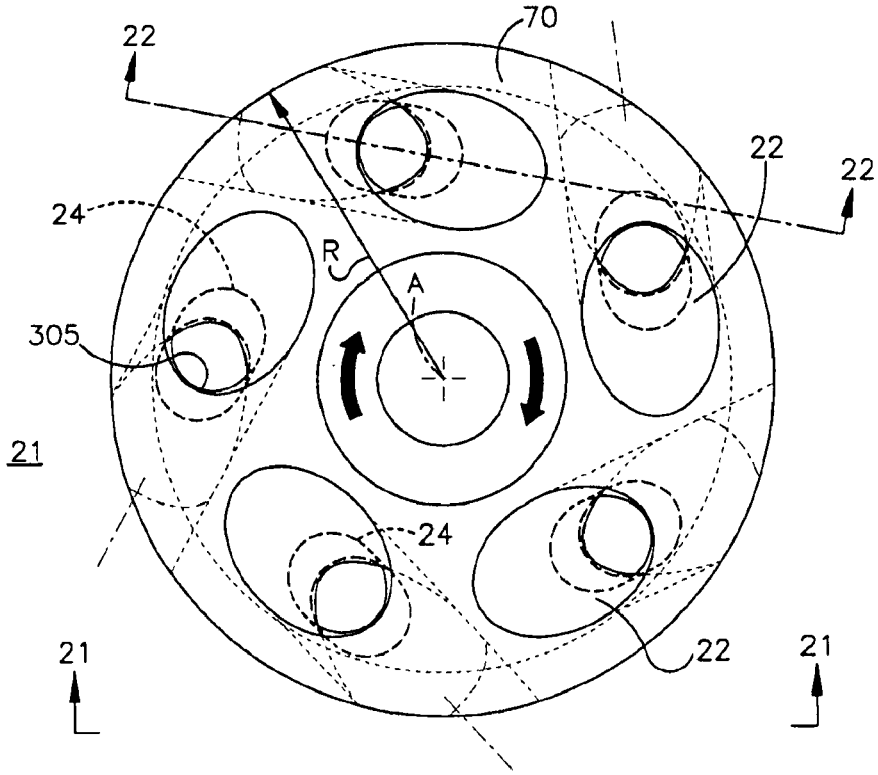
FIG. 20 is a top plan view of the impeller of FIG. 19.
Figure 21:
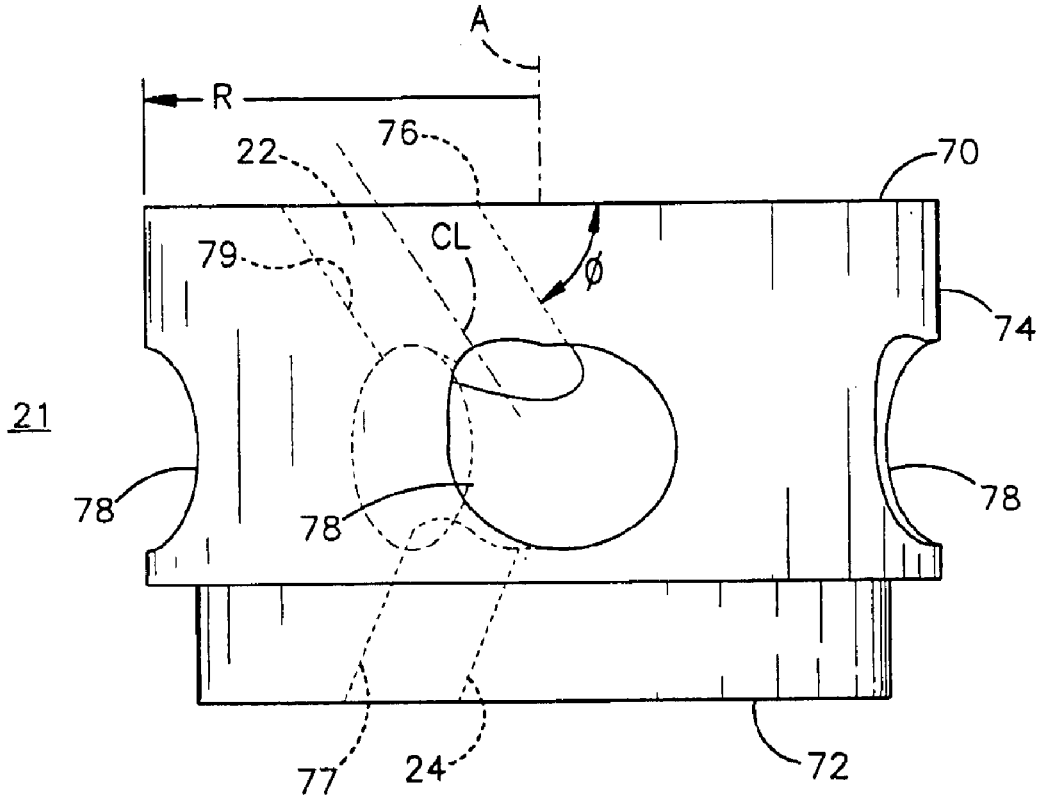
FIG. 21 is a side elevational view of the impeller shown in FIG. 19.

The vaned impeller 100 is shown positioned in a base 150 of a top-and-bottom feed transfer pump in FIGS. 17 and 18. The base includes an impeller chamber 152 and has concentric upper and lower openings 154 with respect to axis A. Annular recesses 156 surround the openings 154 and receive bearing rings 158. These figures illustrate a preferred use of a spiral shaped volute opening 160 and its spacing and arrangement relative to the impeller. The impeller rotates clockwise in the base shown. Extending tangentially to the impeller chamber or, more specifically, the volute opening, is a discharge passage 162 leading to a riser passage 164.

FIGS. 19–22 show a third impeller embodiment of the present invention. In this embodiment, a plurality of upper passages 22 have inlets 76 circumferentially spaced apart from each other on the first face 70. The preferred number of passages is five, but the number may vary as would be apparent to one with ordinary skill in the art in view of this disclosure.

Figure 22:
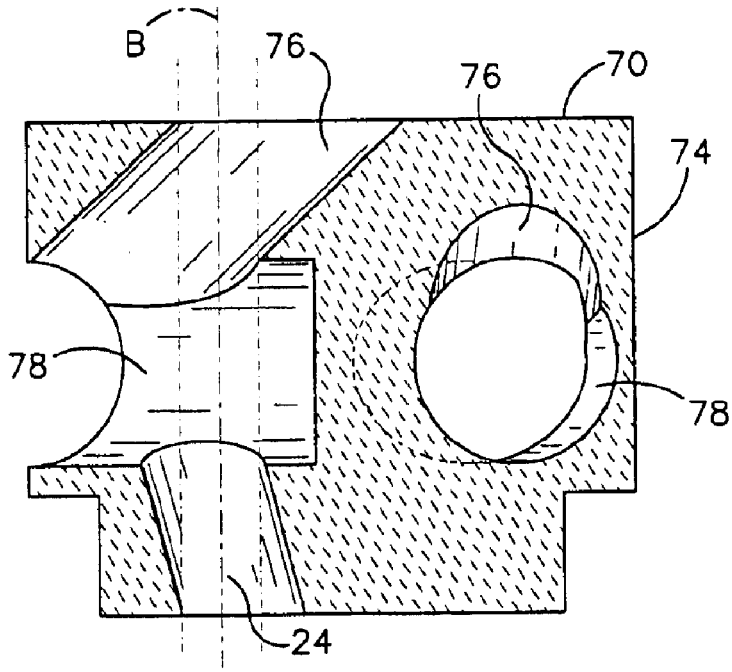
FIG. 22 is a cross-sectional view of the impeller taken from the plane designated 22—22 in FIG. 20.

The impeller also includes lower infeed passages 24 extending from inlets 77 on the second end face 72 and communicating with the upper passages 22 leading to common outlets 78. The pitch of the lower infeed passages 24 is preferably a mirror image of the pitch of the upper passages 22. In addition, each infeed passage 24 and inlet 77 is aligned with a corresponding passage 22 and inlet 76 such that an axis B (FIG. 22) extending from the inlet 76 through upper passage 22 to lower infeed passages 24 and inlet 77 in the second end face 72 of the impeller is substantially parallel to the rotational axis A. The alignment creates substantially round holes 305 (best shown in FIG. 20) through the impeller large enough that a rod or other means can be extended through the impeller to dislodge trapped particles or objects. The rod can be inserted into the inlet 76 in the first end face, passing through passage 22 and exiting through the passage 24 and inlet 77, following the axis B (FIG. 22). In certain cases, the entrance port may be extended on the face of the impeller to allow for an increased passage angle. The extention 307 of the ports are best shown in FIG. 25. Debris can be loosened and removed without removing the impeller or placing the worker at risk of injury as a result of the passage alignment of the invention shown in FIGS. 19–25.

Figure 23:
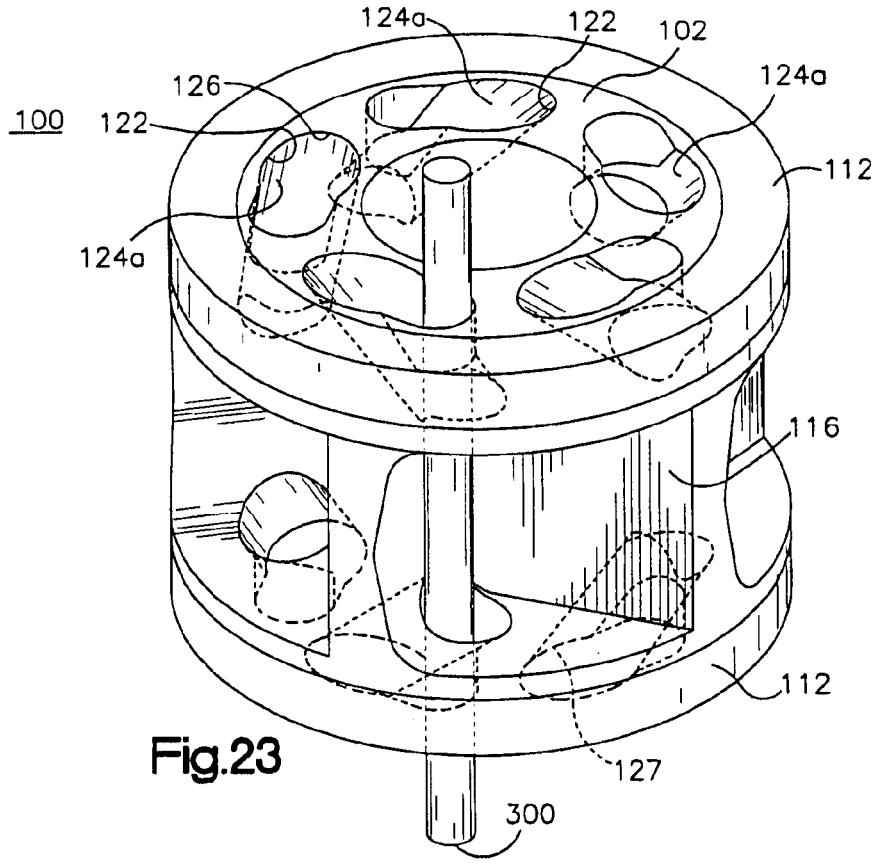
FIG. 23 is a perspective view of an impeller according to the present invention.
Figure 24:
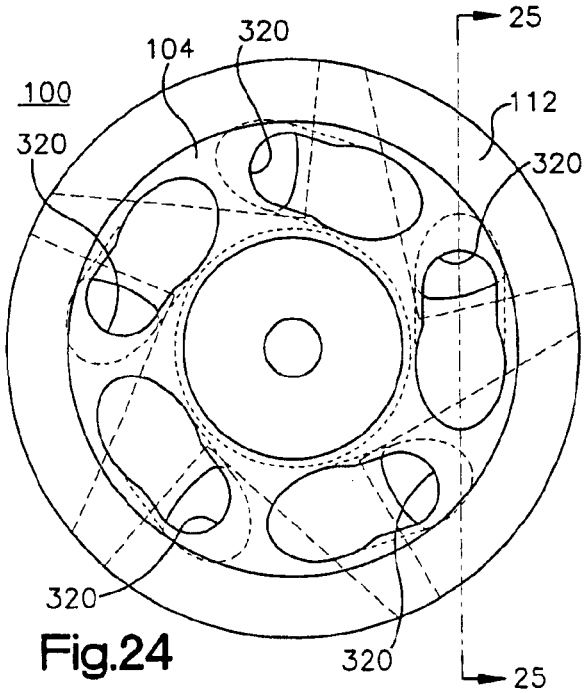
FIG. 24 is a top plan view of the impeller shown in FIG. 19.
Figure 25:
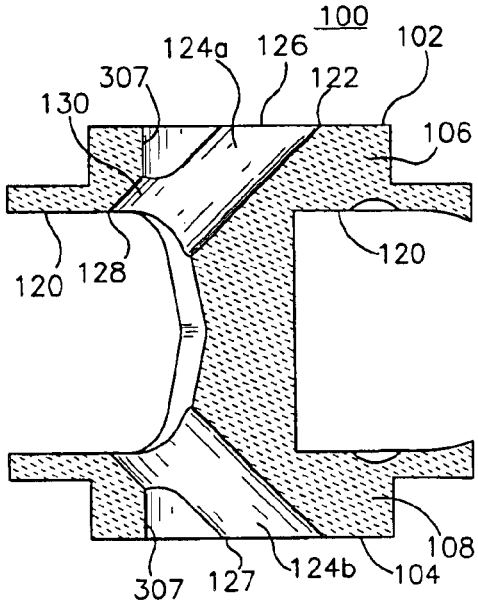
FIG. 25 is a cross-sectional view of the impeller shown in FIG. 19.

FIGS. 23–25 show the vaned impeller according to a fourth embodiment. The vaned impeller includes upper entrance ports or inlets 126 disposed in the first end face 102 in alignment with molten metal entrance ports or inlets 127 of the second end face 104. Upper passages 124*a* extending from the upper inlets 126 in the upper end face 102 and lower passages 124*b* extending from the lower inlets 127 in the lower end face 104 lead to the cavities 120 and are also in alignment such that an axis (represented by rod 300 in FIG. 23) can extend into an inlet 126 and passage 124*a* of upper base 106 through impeller to inlets 127 and passages 124*b* of lower base 108. The alignment produces generally round openings 320 (best shown in FIG. 24) extending through impeller 100.

Figure 26:
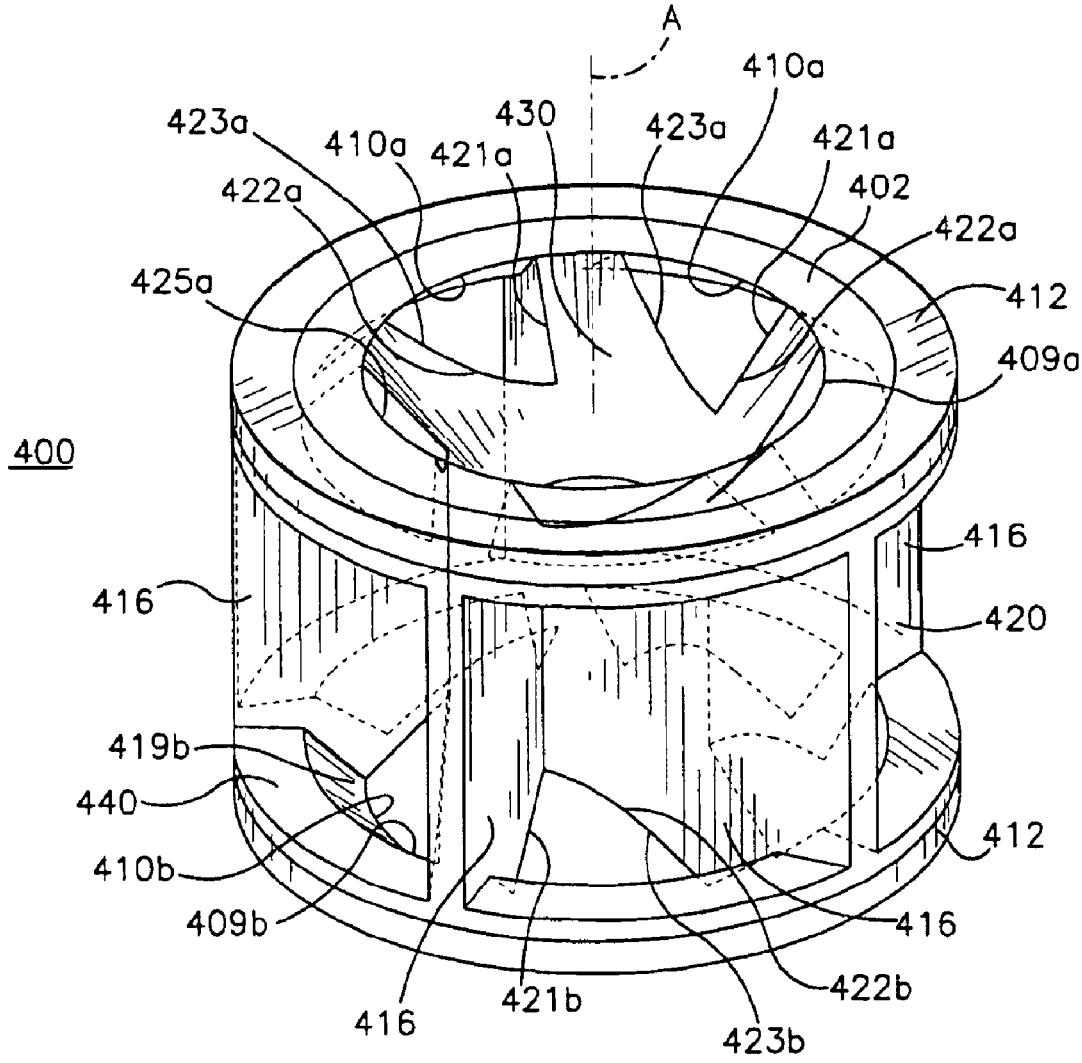
FIG. 26 is a perspective view of an impeller according to the present invention.
Figure 27:
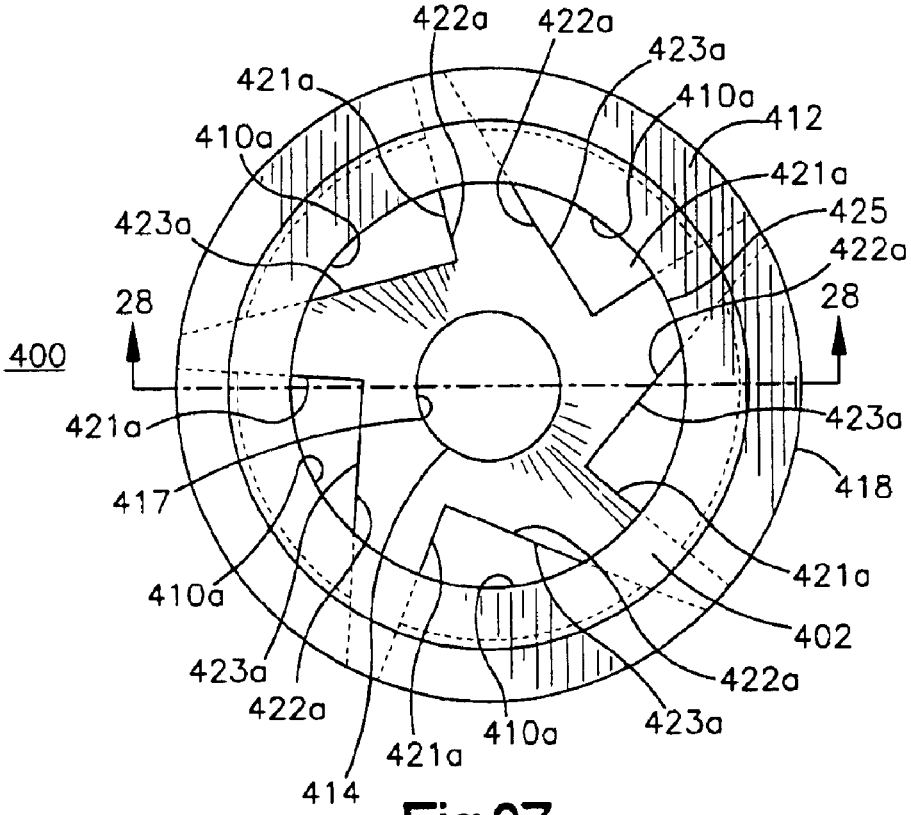
FIG. 27 is a top plan view of the impeller shown in FIG. 26.
Figure 28:
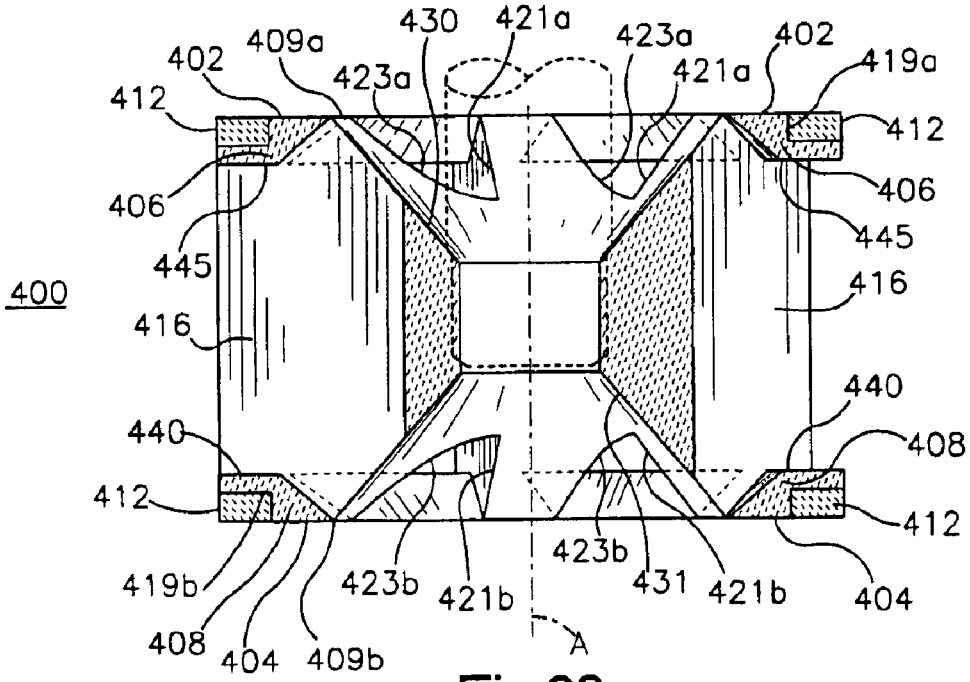
FIG. 28 is a cross-sectional view of the impeller a seen along a plane designated 28—28 in FIG. 27.

FIGS. 26–36 show further embodiments of the present invention in which the impellers are made of a non-metallic, heat resistant material, such as graphite and/or ceramic, suitable for operating in molten metal. In the fifth embodiment, FIGS. 26–28 show an impeller 400 which includes a rotational axis A and first and second end faces 402, 404 extending perpendicular to the central axis A. The first end face 402 is formed by the top surfaces of an upper base 406 of the impeller and the second end face 404 is formed by the bottom surface of a lower base 408 of the impeller (FIG. 28). Both the upper base 406 and the lower base 408 include an opening (409*a*, 409*b* respectively), centered about the central axis A. The impeller bases 406, 408 are defined by the volume of material in a radial direction from peripheral edge 425 of each of the openings 409*a*, 409*b* to the outer peripheral surface 418 of the impeller 400 and, in a direction along axis A shown in FIG. 28, providing the impeller bases 406, 408 with a substantially ring-shaped geometry. The impeller bases 406 and 408 include, an annular recess 419*a*, 419*b*, respectively, in which an annular bearing member 412 resides. The annular bearing member is formed from a wear resistant material, preferably ceramic, and is affixed in place. The volume of the base members as described above relative to the direction of the axis A may be described as extending between end face 402 and upper internal edge 445 and between lower end face 404 and lower internal edge 440.

The generally cylindrical hub portion 414 (FIG. 27) is centrally disposed between the upper impeller base 406 and the lower impeller base 408 along the rotational axis A. The hub portion 414 includes a mounting hole 417 for attaching an impeller shaft. The shaft can be mounted in any conventional manner known to those of ordinary skill in the art. Preferably the mounting hole is interiorly threaded along the central axis A. A plurality of vanes 416, preferably five, extend outwardly from the hub portion 414, to the outer peripheral surface 418 of the impeller. The vanes 416 also extend from the upper end face 402 to the lower end face 404 in a direction generally along the axis A. Cavities 420 are disposed between each pair of adjacent vanes 416 and between the first base 406 and second base 408. The impeller also includes an upper vane wall section 430 and a lower vane wall section 431 (FIG. 28). The upper vane wall section 430 is preferably intergrally formed with the hub portion 414 and the upper base 406. The lower vane wall section 431 is preferably intergrally formed with the hub portion 414 and the lower base 408. The upper vane wall section 430 includes a plurality of inlets 422*a* and the lower vane wall section includes a plurality of inlets 422*b*. The upper inlets 422*a* communicating the opening 409*a* in the upper base 406 with the cavities 420. Likewise, the lower inlets 422*b* communicating the opening 409*b* in the lower base 408 with the cavities.

The upper vane wall section 430 connecting the upper base 406 to the hub portion 414 and lower vane wall section 431 connecting the lower base 408 to the hub portion 414 are conical in shape. The inlets 422*a* in the upper vane wall section 430 extend substantially from the hub portion 414 to the outer face 402 of the upper impeller base 406 in a generally radial direction. The inlets 422*b* in the lower vane wall section 431 extend substantially from the hub portion 414 to the outer face of the lower impeller base 408 in a generally radial direction. The inlets 422*a*, 422*b*, take on generally a triangular shape. The upper inlets 422*a* are defined by the shape of the adjacent vanes 416 on two sides 421*a*, 423*a* and a portion of the upper base 406 on the other side 410*a*. The lower inlets 422*b* are defined by the shape of the adjacent vanes 416 on two sides 421*b*, 423*b* and a portion of the lower base 408 on the other side 410*b*. The upper and lower bases 406, 408 include bevels at the juncture of the inlets 422*a*, 422*b* with the respective base to allow the inlets 422*a*, 422*b* to extend to the outer face 402, 404 of the respective impeller base 406, 408.

Figure 29:
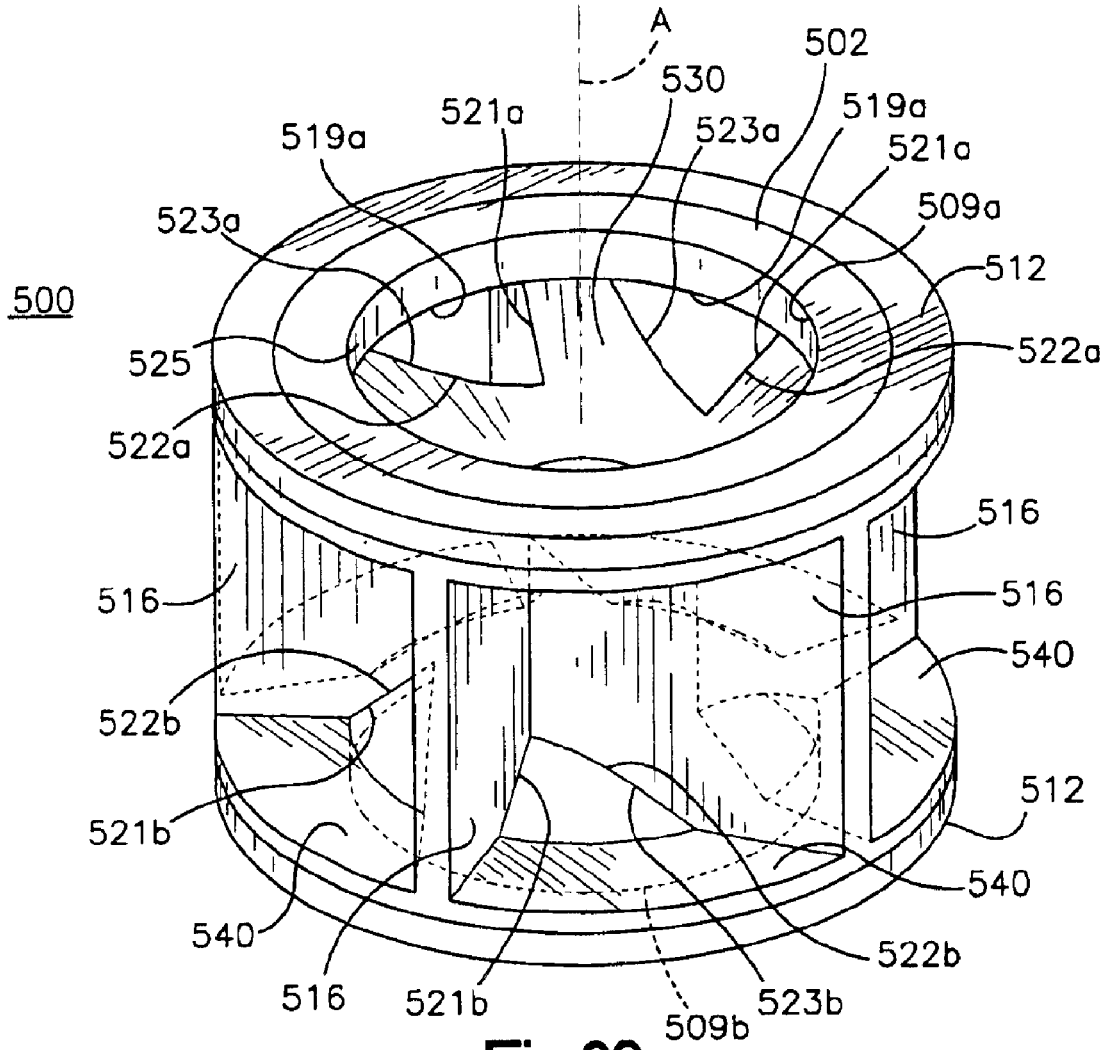
FIG. 29 is an impeller according to the present invention.
Figure 30:
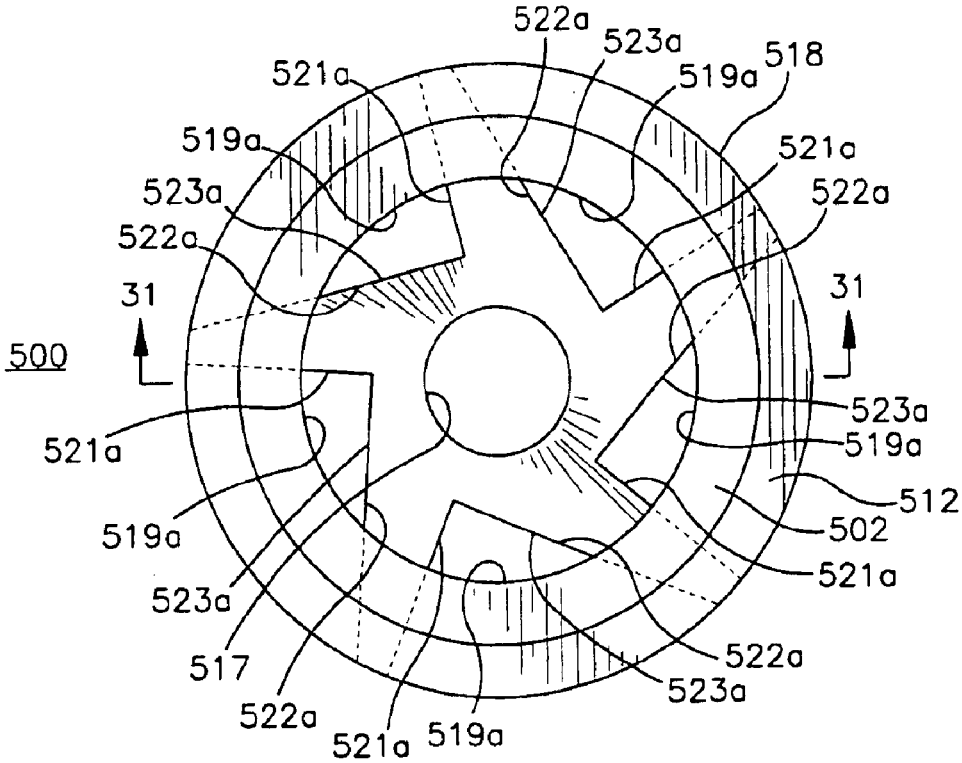
FIG. 30 is a top plan view of the impeller shown in FIG. 29.
Figure 31:
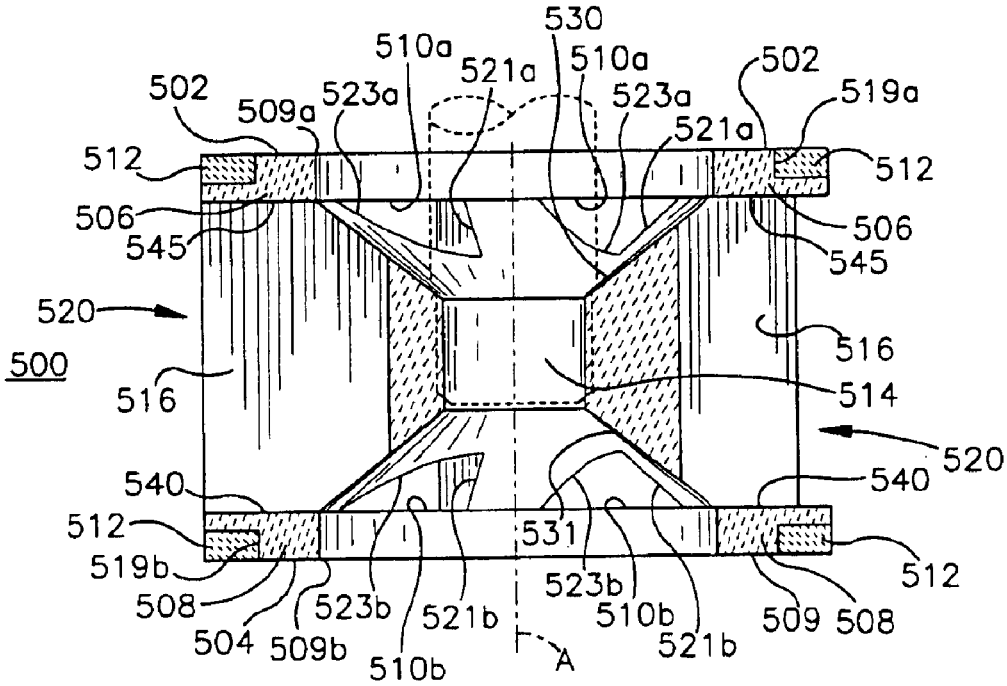
FIG. 31 is a cross-sectional view of the impeller seen along the plane designated 31—31 in FIG. 30.

Referring to FIGS. 29–31, a sixth embodiment is shown. Impeller 500 includes a rotational axis A and first and second end faces 502, 504 extending perpendicular to the central axis A. The first end face 502 is formed by the top surfaces of an upper base 506 of the impeller and the second end face 504 is formed by the bottom surface of a lower base 508 of the impeller (FIG. 31). Both the upper base 506 and the lower base 508 include an opening (509*a*, 509*b* respectively), centered about the central axis A. The impeller bases 506, 508 are defined by the volume of material in a radial direction from peripheral edge 525 of each of the openings 509*a*, 509*b* to the outer peripheral surface of the impeller 518 and, in a direction along axis A shown in FIG. 31, providing the impeller bases 506, 508 with a substantially ring-shaped geometry. The impeller bases 506 and 508 include an annular recess 519*a*, 519*b*, respectively, in which an annular bearing member 512 resides. The annular bearing member is formed from a wear resistant material, preferably ceramic, and is affixed in place. The volume of the base members as described above relative to the direction of the axis A may be described as extending between end face 502 and upper internal edge 545 and between lower end face 504 and lower internal edge 540.

The generally cylindrical hub portion 514 (FIG. 31) is centrally disposed between the first impeller base 506 and the lower impeller base 508 along the rotational axis A. The hub portion 514 includes a mounting hole 517 for attaching an impeller shaft. The shaft can be mounted in any conventional manner known to those of ordinary skill in the art. Preferably the mounting hole is interiorly threaded along the central axis A. A plurality of vanes 516, preferably five, extend outwardly from the hub portion 514, to the outer peripheral surface 518 of the impeller 500. The vanes 516 also extend from the upper end face 502 to the lower end face 504 in a direction generally along the axis A. Cavities 520 are disposed between each pair of adjacent vanes 516 and between the first base 506 and second base 508. The impeller also includes an upper vane wall section 530 and a lower vane wall section 531 (FIG. 31). The upper vane wall section 530 is preferably intergrally formed with the hub portion 514 and the upper base 506. The lower vane wall section 531 is preferably intergrally formed with the hub portion 514 and the lower base 508. The upper vane wall section 530 includes a plurality of inlets 522*a* and the lower vane wall section 531 includes a plurality of inlets 522*b*. The upper inlets 522*a* communicating the opening 509*a* in the upper base 506 with the cavities 520. Likewise, the lower inlets 522*b* communicating the opening 509*b* in the lower base 508 with the cavities 520.

The upper vane wall section 530 connecting the upper base 506 to the hub portion 514 and the lower vane wall section 531 connecting the lower base to the hub portion 514 are substantially conical in shape. The inlets 522*a* in the upper vane wall section 530 extend substantially from the hub portion 514 to the upper internal edge 545 of the upper base 506 in a generally radial direction. The inlets 522*b* in the lower internal wall section 531 extend substantially from the hub portion 514 to the lower internal edge 540 of the lower base 508 in a generally radial direction. The bases 506, 508 do not include a bevel at connection of the inlets 522*a*, 522*b* to the base. Inlets 522*a*, 522*b* do not extend to the outer face of the respective base 502, 504. The inlets 522*a*, 522*b* take on a generally triangular shape. The upper inlets 522*a* are defined by the shape of the adjacent vanes 516 on two sides 521*a*, 523*a* and a portion of the internal edge 545 of the upper base 506 on the other side 510*a*. The lower inlets 522*b* are defined by the shape of the adjacent vanes 516 on two sides 521*b*, 523*b* and the internal edge 540 of the lower base 508 on the other side 510*b*.

Figure 32:
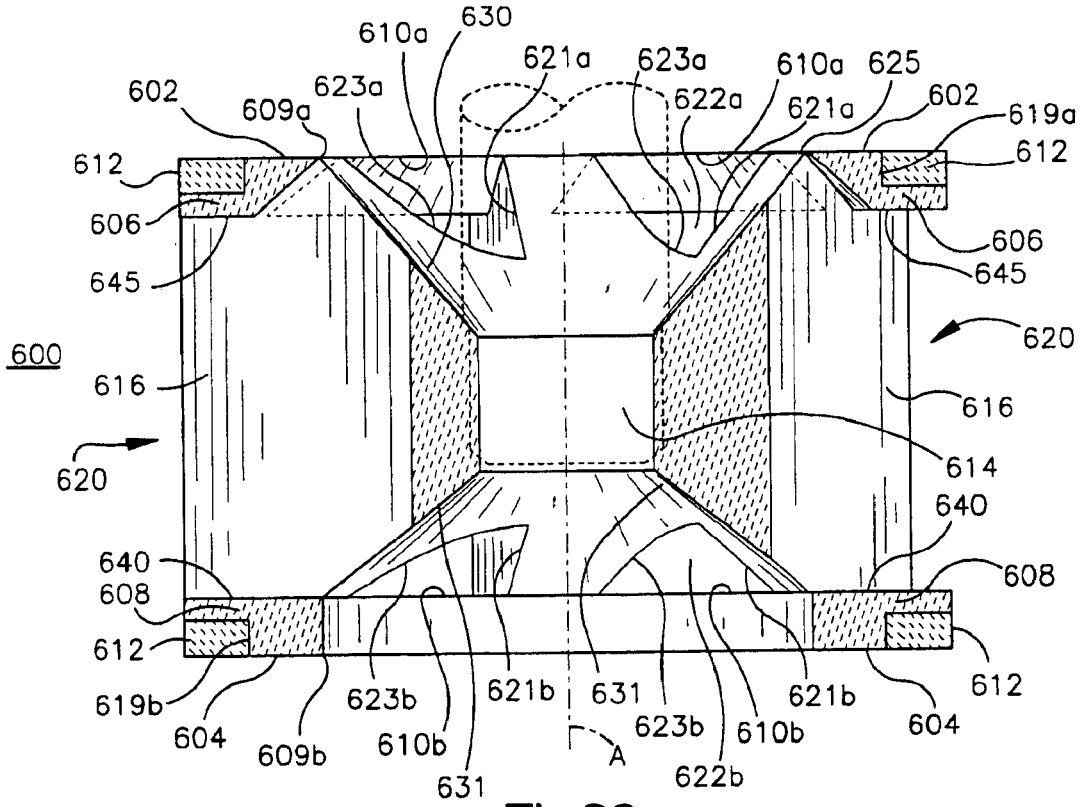
FIG. 32 is a perspective view of an impeller according to the present invention.
Figure 33:
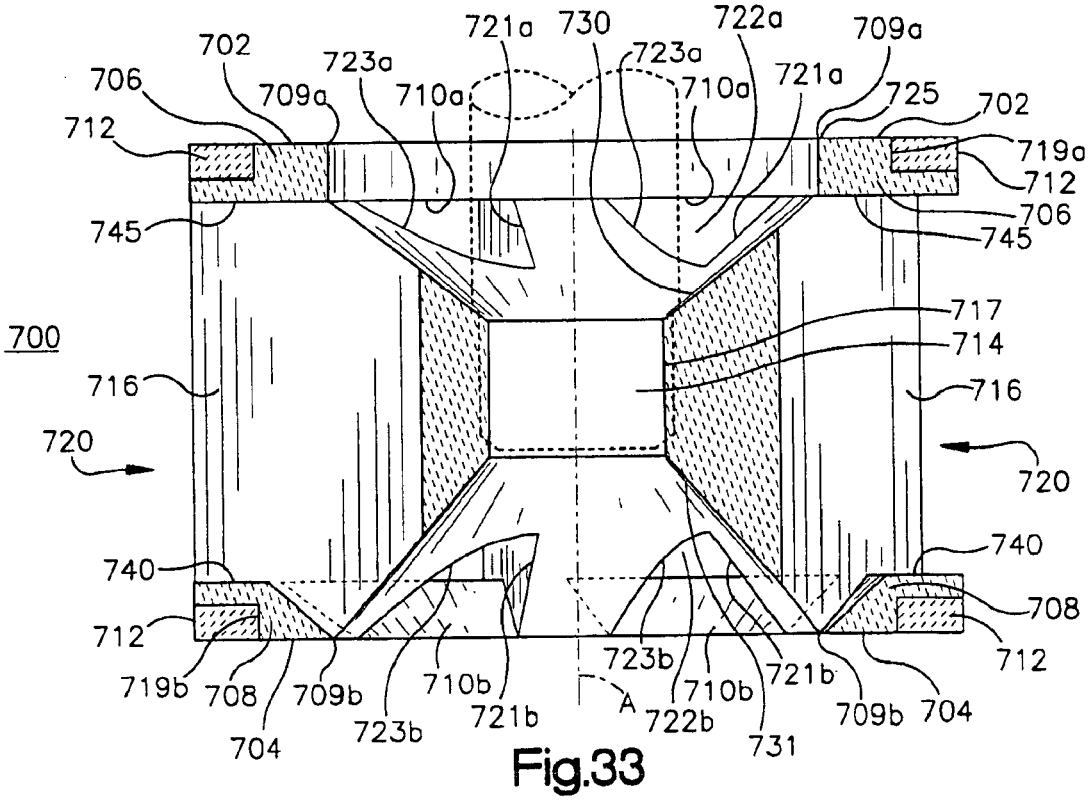
FIG. 33 is a perspective view of an impeller according to the present invention.

FIGS. 32 and 33 show two additional embodiments. In FIG. 32, impeller 600 which includes a rotational axis A and first and second end faces 602, 604 extending perpendicular to the central axis A. The first end face 602 is formed by the top surfaces of an upper base 606 of the impeller and the second end face 604 is formed by the bottom surface of a lower base 608 of the impeller. Both the upper base 606 and the lower base 608 include an opening (609*a*, 609*b* respectively), centered about the central axis A. The impeller bases 606, 608 are defined by the volume of material in a radial direction from peripheral edge 625 of each of the openings 609*a*, 609*b* to the outer peripheral surface of the impeller 600 and, in a direction along axis A providing the impeller bases 606, 608 with a substantially ring-shaped geometry. The impeller bases 606 and 608 include an annular recess 619*a*, 619*b*, respectively, in which an annular bearing member 612 resides. The annular bearing member 612 is formed from a wear resistant material, preferably ceramic, and is affixed in place. The volume of the base members as described above relative to the direction of the axis A may be described as extending between end face 602 and upper internal edge 645 and between lower end face 604 and lower internal edge 640.

The generally cylindrical hub portion 614 is centrally disposed between the first impeller base 606 and the lower impeller base 608 along the rotational axis A. The hub portion 614 includes a mounting hole for attaching an impeller shaft. The shaft can be mounted in any conventional manner known to those of ordinary skill in the art. Preferably the mounting hole is interiorly threaded along the central axis A in FIG. 32. A plurality of vanes 616, preferably five, extend outwardly from the hub portion 614, to the outer peripheral surface of the impeller. The vanes 616 also extend from the upper end face 602 to the lower end face 604 in a direction generally along the axis A. Cavities 620 are disposed between each pair of adjacent vanes 616 and between the first base 606 and second base 608. The impeller also includes an upper vane wall section 630 and a lower vane wall section 631. The upper vane wall section 630 is preferably intergrally formed with the hub portion 614 and the upper base 606. The lower vane wall section 631 is preferably intergrally formed with the hub portion 614 and the lower base 608. The upper vane wall section 630 includes a plurality of inlets 622*a* and the lower vane wall section 631 includes a plurality of inlets 622*b*. The upper inlets 622 communicating the opening 609*a* in the upper base 606 with the cavities 620. Likewise, the lower inlets 622*b* communicating the opening 609*b* in the lower base 60 8 with the cavities 620.

The upper vane wall section 630 connecting the upper base 606 to the hub portion 614 and the lower vane wall section 631 connecting the lower base 608 to the hub portion 614 are substantially conical in shape. The inlets 622*a* in the upper vane wall section 630 extend substantially from the hub portion 614 to the outer face 602 of the first impeller base 606 in a generally radial direction. The inlets 622*a* in the upper vane wall section 630 are generally triangular in shape and are defined by the shape of the adjacent vanes 616 on two sides 621*a*, 623*a* and a portion of the outer face 602 of the upper impeller base 406 on the other side 610*a*. The upper base 606 includes bevels at the juncture of the inlets 622*a* with the upper base 606 to allow the inlets 622*a* to extend to the outer face 602 of the upper impeller base 606. The lower internal vane section 631 is substantially conical in shape and extends substantially from the hub portion 614 to the internal edge 640 of the lower base 608 and includes inlets 622*b*. The inlets 622*b* extend substantially from the hub portion 614 to the internal edge 640 of the lower impeller base 608 in a generally radial direction communicating the opening 609*b* with the cavities 620. The inlets 622*b* in the lower vane wall section 631 are generally triangular in shape and are defined by the shape of the adjacent vanes 616 on two sides 621*b*, 623*b* and a portion of the internal edge 640 of the lower base 608 on the other side 610*b*.

FIG. 33 shows yet another aspect of the fifth embodiment. Impeller 700 includes a rotational axis A and first and second end faces 702, 704 extending perpendicular to the central axis A. The first end face 702 is formed by the top surfaces of an upper base 706 of the impeller and the second end face 704 is formed by the bottom surface of a lower base 708 of the impeller. Both the upper base 706 and the lower base 708 include an opening (709*a*, 709*b* respectively), centered about the central axis A. The impeller bases 706, 708 are defined by the volume of material in a radial direction from peripheral edge 725 of each of the openings 709*a*, 709*b* to the outer peripheral surface of the impeller 700 and, in a direction along axis A providing the impeller bases 706, 708 with a substantially ring-shaped geometry. The impeller bases 706 and 708 include an annular recess 719*a*, 719*b*, respectively, in which an annular bearing member 712 resides. The annular bearing member is formed from a wear resistant material, preferably ceramic, and is affixed in place. The volume of the base members as described above relative to the direction of the axis A may be described as extending between end face 702 and upper internal edge 745 and between lower end face 704 and lower internal edge 740.

The generally cylindrical hub portion 714 is centrally disposed between the first impeller base 706 and the lower impeller base 708 along the rotational axis A. The hub portion 714 includes a mounting hole 717 for attaching an impeller shaft. The shaft can be mounted in any conventional manner known to those of ordinary skill in the art. Preferably the mounting hole is interiorly threaded along the central axis A. A plurality of vanes 716, preferably five, extend outwardly from the hub portion 714, to the outer peripheral surface of the impeller. The vanes 716 also extend from the upper end face 702 to the lower end face 704 in a direction generally along the axis A. Cavities 720 are disposed between each pair of adjacent vanes 716 and between the first base 706 and second base 708. The impeller also includes an upper vane wall section 730 and a lower vane wall section 731. The upper vane wall section 730 is preferably intergrally formed with the hub portion 714 and the upper base 706. The lower vane wall section 731 is preferably intergrally formed with the hub portion 714 and the lower base 708. The upper vane wall section 730 includes a plurality of inlets 722*a* and the lower vane wall section 731 includes a plurality of inlets 722*b*. The upper inlets 722*a* communicating the opening 709*a* in the upper base 706 with the cavities 720. Likewise, the lower inlets 722*b* communicating the opening 709*b* in the lower base 708 with the cavities 720.

The upper internal vane section 730 is substantially conical in shape and extends substantially from the hub portion 714 to the upper base 706. The inlets 722*a* extend substantially from the hub portion 714 to the internal edge 745 of the upper impeller base 706 in a generally radial direction. The inlets 722*a* in the upper vane wall section 730 are generally triangular in shape and are defined by the shape of the adjacent vanes 716 on two sides 721*a*, 723*a* and a portion of the internal edge 745 of the upper base 706 on the other side 710*a*. The lower vane wall section 731 connecting the lower base 708 to the hub portion 714 is substantially conical in shape. The lower vane wall section 731 extends substantially from the hub portion 714 to the lower impeller base 708 and includes inlets 722*b*. The inlets 722*b* in the lower vane wall section 731 extend substantially from the hub portion 714 to the outer face 704 of the lower impeller base 708 in a generally radial direction. The inlets 722*b* in the lower vane wall section 731 are generally triangular in shape and are defined by the shape of the adjacent vanes 716 on two sides 721*b*, 723*b* and the outer face 704 of the lower impeller base 708 on the other side 710*b*. The lower base 708 include bevels at the juncture of the inlets 722*b* with the lower impeller base 708 to allow the inlets 722*b* to extend to the outer face 704 of the lower impeller base 708.

Figure 34:
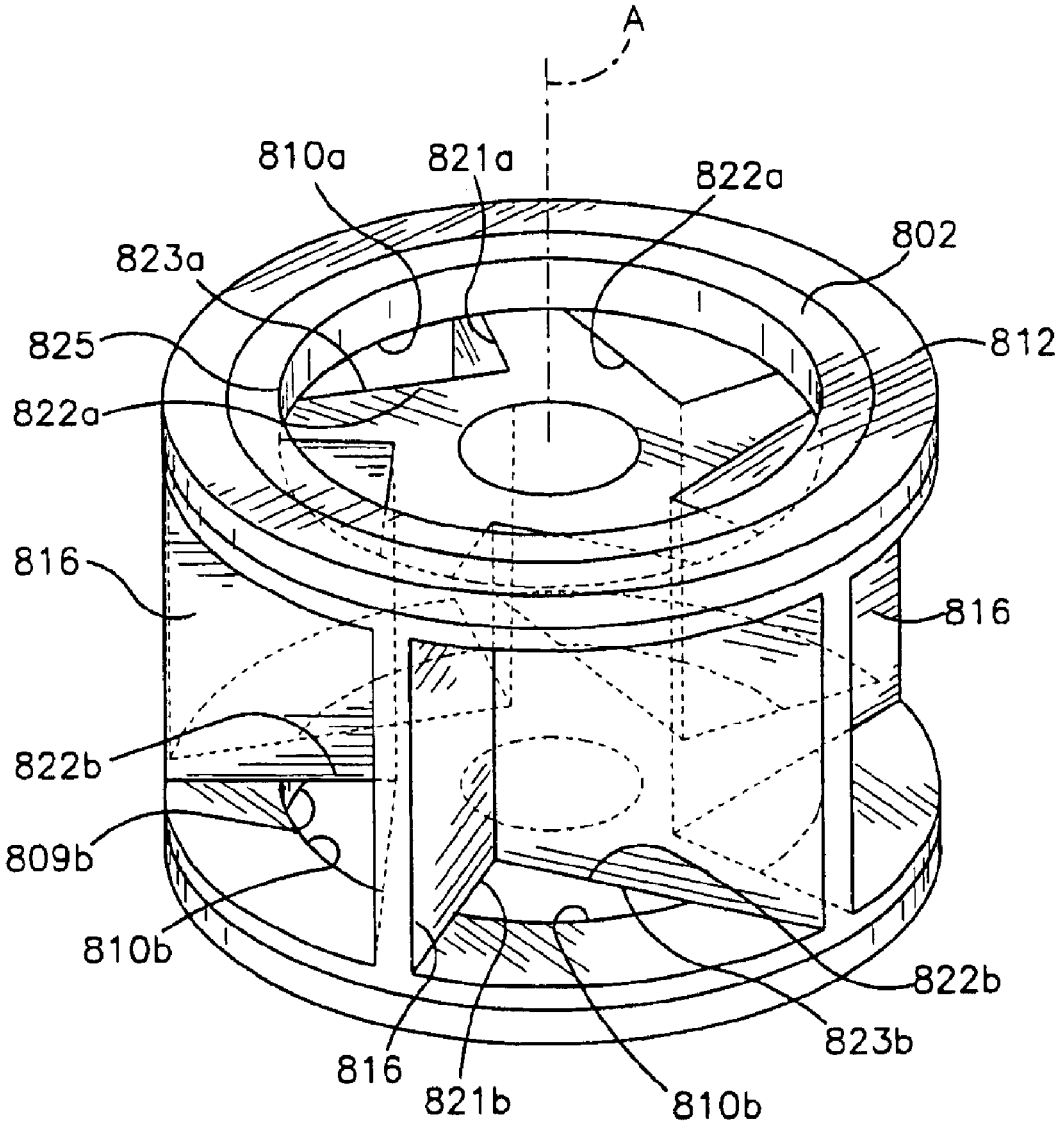
FIG. 34 is a perspective view of an impeller according to the present invention.
Figure 35:
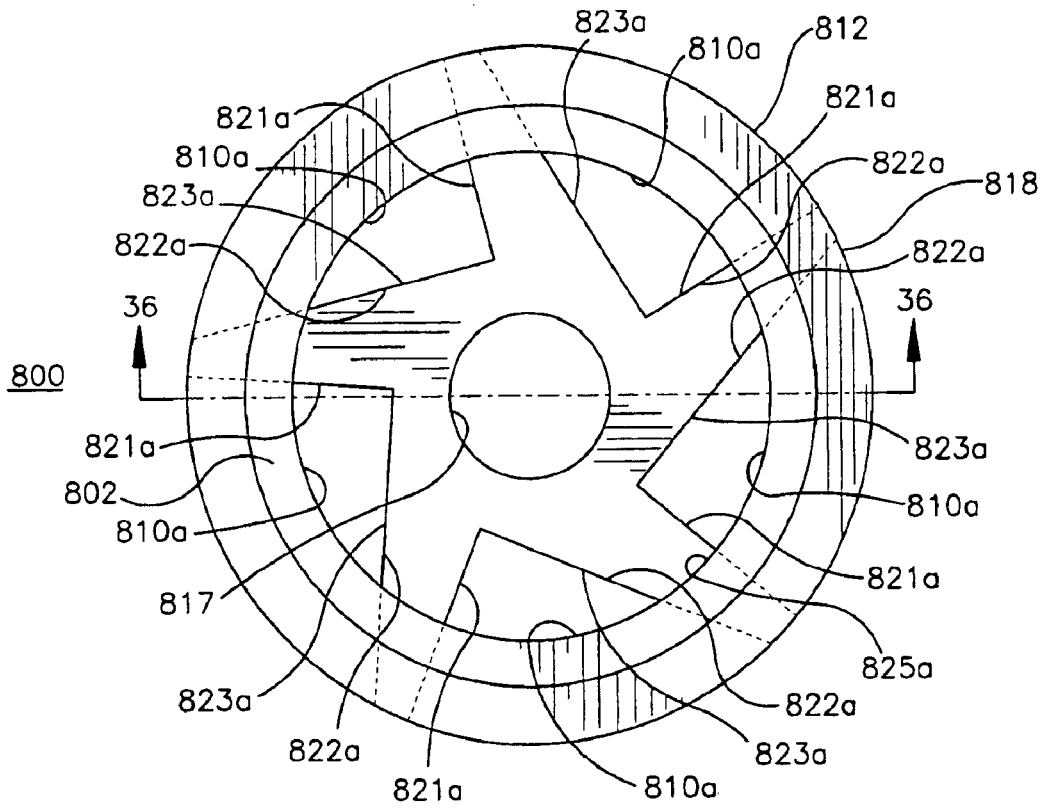
FIG. 35 is a top plan view of the impeller shown in FIG. 34.
Figure 36:
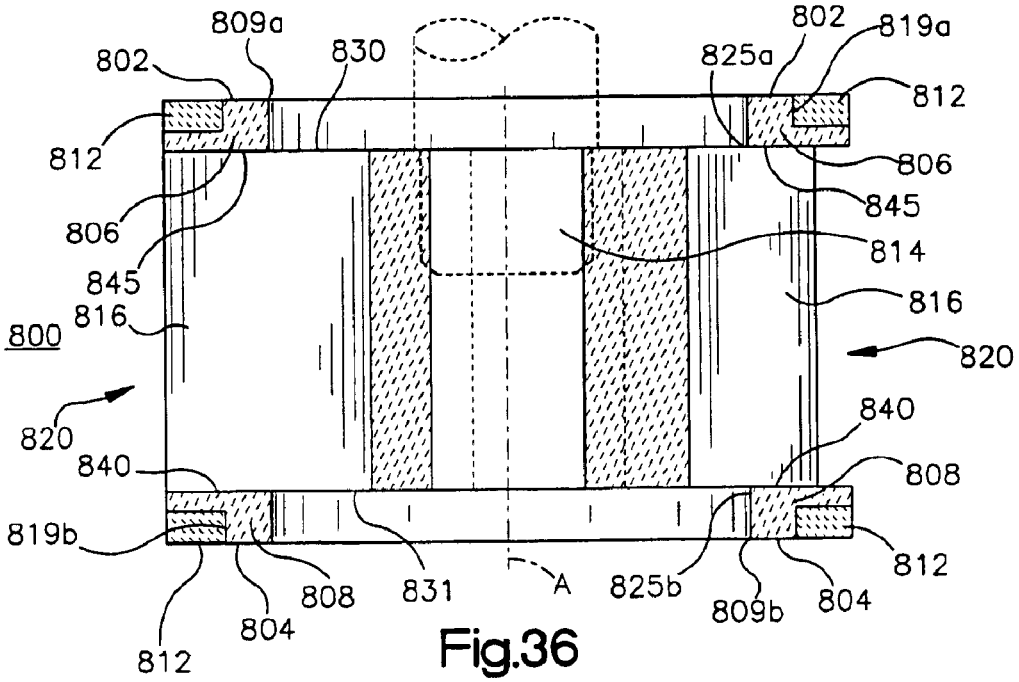
FIG. 36 is a cross-sectional view of the impeller as seen along the plane designated 36—36 in FIG. 35.

FIGS. 34–36 show yet another embodiment of the present invention. Impeller 800 which includes a rotational axis A and first and second end faces 802, 804 extending perpendicular to the central axis A. The first end face 802 is formed by the top surfaces of an upper base 806 of the impeller and the second end face 804 is formed by the bottom surface of a lower base 808 of the impeller (FIG. 36). Both the upper base 806 and the lower base 808 include an opening (809*a*, 809*b* respectively), centered about the central axis A. The impeller bases 806, 808 are defined by the volume of material in a radial direction from peripheral edge 825 of each of the openings 809*a*, 809*b* to the outer peripheral surface 818 of the impeller 800 and, in a direction along axis A providing the impeller bases 806, 808 with a substantially ring-shaped geometry. The impeller bases 806 and 808 include an annular recess 819*a*, 819*b*, respectively, in which an annular bearing member 812 resides. The annular bearing member is formed from a wear resistant material, preferably ceramic, and is affixed in place. The volume of the base members as described above relative to the direction of the axis A may be described as extending between end face 802 and upper internal edge 845 and between lower end face 804 and lower internal edge 840.

The generally cylindrical hub portion 814 (FIG. 36) is centrally disposed between the first impeller base 806 and the lower impeller base 808 along the rotational axis A and extends from the internal edge 840 of the lower base 808 to the internal edge 845 of the upper base 806. The hub portion 814 includes a mounting hole 817 for attaching an impeller shaft. The shaft can be mounted in any conventional manner known to those of ordinary skill in the art. Preferably the mounting hole is interiorly threaded along the central axis A. A plurality of vanes 816 extends radially from the hub portion 814 for the entire length between the internal edge 840 of the lower base 808 and internal edge 845 of the upper base 806 to the outer peripheral surface 818. Cavities 820 are disposed between each pair of adjacent vanes 816 and between the first base 806 and second base 808.

The impeller 800 also includes a flat upper vane portion 830 and a flat lower vane portion 831. The flat upper vane portion 830 extends radially from the hub portion 814 to the peripheral edge 825*a* (FIG. 36) of the opening 809*a* in the upper impeller base 806 and lies generally parallel to the upper impeller base 806. The upper vane portion 830 does not extend along the central axis past the internal edge 845 of the upper base 806. The flat upper vane portion 830 includes a plurality of inlets 822*a* communicating the opening 809*a* in the upper impeller base 806 with the cavities 820. The inlets 822*a* are generally triangular in shape and are defined by the shape of the vanes 816 on two sides 821*a*, 823*a* and a portion of the internal edge 845 of the upper base 806 on the other side 810*a*. The opening 809*a* in the upper base 806 is preferably larger than the hub portion 814 such that the diameter of the opening may affect the size of the inlets 822*a*. The flat lower vane wall portion 831 extends radially from the hub portion 814 to the peripheral edge 825*b* (FIG. 36) of the opening 809*b* in the lower impeller base 808 and lies parallel to the lower impeller base 808. The lower vane wall portion 831 does not extend along the central axis past the internal edge 840 of the lower base 808. The flat lower vane portion 831 includes a plurality of inlets 822*b* communicating the opening 809*b* in the lower impeller base 808 with the cavities 820. The inlets 822*b* are generally triangular in shape and are defined by the shape of the vanes 816 on two sides 821*b*, 823*b* and a portion of the internal edge 840 of the lower base 808 on the other side 810*b*. The opening 809*b* in the lower base 808 is preferably larger than the hub portion 814 such that the diameter of the opening may affect the size of the inlets 822*b*.

Many modifications and variations of the invention will be apparent to those of ordinary skill in the art in light of the foregoing disclosure. Therefore, it is to be understood that, within the scope of the appended claims, the invention can be practiced otherwise than has been specifically shown and described.

What is claimed is:

1. An impeller made of non-metallic, heat resistant material, comprising;

a generally cylindrical shaped body having a central rotational axis;

first and second end faces extending transverse to the central axis;

a side wall extending between the first and second end faces;

a plurality of first inlet openings spaced apart from each other on said first end face;

a plurality of second inlet openings spaced apart from each other on said second end face;

connecting passages extending in the body of said impeller; and outlet openings located at said side wall;

wherein said outlet openings are connected to said first inlet openings and said second inlet openings by said connecting passages, and wherein said first inlet openings and said second inlet openings are in alignment such that a rod extending generally parallel to the central axis can simultaneously extend through said first inlet openings and said second inlet openings.

2. The impeller of claim 1 comprising a bearing member attached to said body near at least one of said first end face and said second end face.

3. The impeller of claim 1 wherein said connecting passages extend from said first end face to said outlet openings in a direction away from a direction of rotation of said first end face and said connecting passages extend from said second end face to said outlet openings in a direction away from a direction of rotation of said second end face.

4. An impeller made of non-metallic, heat resistant material comprising:

a central hub portion extending along a rotational axis of the impeller;

a first impeller base and a second impeller base extending from the hub portion at opposing end portions of the impeller transverse to the central axis, said first impeller base and said second impeller base each comprising an outer end face;

vanes extending from said central hub portion between the first impeller base and the second impeller base, wherein cavities are formed between said first and second impeller bases and between adjacent said vanes; and, a plurality of first molten metal passages spaced apart from one another in said first end face and a plurality of second molten metal passages spaced apart from one another in said second end face, said first passages and said second passages terminating at said cavities;

wherein said first passages and said second passages are in alignment such that a rod extending generally parallel to the central axis can simultaneously extend through said first passages and said second passages.

5. The impeller of claim 4 comprising a bearing member attached near at least one of said first end face and said second end face.

6. The impeller of claim 4 wherein said first passages extend from said first end face to said cavities in a direction away from a direction of rotation of said first end face and said second passages extend from said second end face to said cavities in a direction away from a direction of rotation of said second end face.

7. In a pump for pumping molten metal including a motor, a shaft having one end connected to the motor, an impeller connected to the other end of the shaft, a base having an impeller chamber in which the impeller is rotatable, concentric openings in upper and lower portions of said base, and an elongated discharge passageway that extends from said impeller chamber, the improvement wherein the impeller is made of non-metallic, heat resistant material comprising:

a generally cylindrical shaped body having a central rotational axis;

first and second end faces extending transverse to the central axis;

a side wall extending between the first and second end faces;

a plurality of first inlet openings spaced apart from each other on said first end face;

a plurality of second inlet openings spaced apart from each other on said second end face;

connecting passages extending in the body of said impeller; and outlet openings located at said side wall;

wherein said outlet openings are connected to both said first inlet openings and said second inlet openings by said connecting passages, and wherein said first inlet openings and said second inlet openings are in alignment such that a rod extending generally parallel to the central axis can simultaneously extend through said first inlet openings and said second inlet openings.

8. In a pump for pumping molten metal including a motor, a shaft having one end connected to the motor, an impeller connected to the other end of the shaft, a base having an impeller chamber in which the impeller is rotatable, concentric openings in upper and lower portions of said base, and an elongated discharge passageway that extends from said impeller chamber, the improvement wherein the impeller is made of non-metallic, heat resistant material comprising:

a central hub portion extending along a rotational axis of the impeller;

a first impeller base and a second impeller bases extending from the hub portion at opposing end portions of the impeller transverse to the central axis, said first impeller base and said second impeller base each comprising an outer end face;

vanes extending from said central hub portion between the first impeller base and the second impeller base, wherein cavities are formed between said first impeller base and said second impeller base and between adjacent said vanes; and a plurality of first molten metal passages spaced apart from one another in said first end face and a plurality of second molten metal passages spaced apart from one another in said second end face, said first passages and said second passages terminating at said cavities;

wherein said first passages and said second passages are in alignment such that a rod extending generally parallel to the central axis can simultaneously extend through said first passages and said second passages.

9. An impeller for a molten metal pump made of non-metallic, heat resistant material comprising:

a first annular impeller base including a first opening located around a rotational axis of the impeller, wherein said first impeller base includes a first face;

a second annular impeller base including a second opening located around the rotational axis of the impeller, wherein said second impeller base includes a second face;

a hub portion positioned along the rotational axis of the impeller and disposed between said first impeller base and said second impeller base; and vanes extending from said hub portion between said first impeller base and said second impeller base, wherein cavities are formed between said first impeller base and said second impeller base and between adjacent said vanes, said vanes including a first vane wall section extending from said hub portion to said first impeller base and a second vane wall section extending from the hub portion to said second impeller base;

wherein said first vane wall section includes a plurality of first inlet openings communicating said first opening to said cavities, and said second vane wall section includes a plurality of second inlet openings communicating said second opening with said cavities.

10. The impeller of claim 9 wherein said first vane wall section and said second vane wall section are conical in shape.

11. The impeller of claim 9 comprising a bearing member attached near at least one of said first face and said second end face.

12. The impeller of claim 9 wherein said first vane wall section extends to said first end face.

13. The impeller of claim 9 wherein said first vane wall section extends to a lower surface of said first impeller base.

14. The impeller of claim 9 wherein said first vane wall section is located at an upper portion of the impeller and extends between said hub portion and said first end face and wherein said second vane wall section is located at an lower portion of the impeller and extends between said hub portion and said second end face.

15. The impeller of claim 9 wherein said first vane wall section is located at an upper portion of the impeller and extends between said hub portion and a lower surface of said first impeller base and wherein said second vane wall section is located at a lower portion of the impeller and extends between said hub portion and an upper surface of said second impeller base.

16. The impeller of claim 9 wherein said first vane wall section is located at an upper portion of the impeller and extends between said hub portion and a lower surface of said first impeller base and wherein said second vane wall section is located at an lower portion of the impeller and extends between said hub portion and said second end face.

17. The impeller of claim 9 wherein said first vane wall section is located at an upper portion of the impeller and extends between said hub portion and said first end face and wherein said second vane wall section is located at a lower portion of the impeller and extends between said hub portion and an upper surface of said second impeller base.

18. The impeller of claim 9 wherein said first vane wall section and said second vane wall section are flat.

19. The impeller of claim 9 wherein said first vane wall section is located at an upper portion of the impeller and extends between said hub portion and a lower surface of said first impeller base and wherein said second vane wall section is located at a lower portion of the impeller and extends between said hub portion and an upper surface of said second impeller base, and wherein said first vane wall section and said second vane wall section are flat.

20. In a pump for pumping molten metal including a motor, a shaft having one end connected to the motor, an impeller connected to the other end of the shaft, a base having an impeller chamber in which the impeller is rotatable, concentric openings in upper and lower portions of said base, and an elongated discharge passageway that extends from said impeller chamber, the improvement wherein the impeller is made of non-metallic, heat resistant material comprising:

a first annular impeller base including a first opening located around a rotational axis of the impeller, wherein said first impeller base includes an outer end face;

a second annular impeller base including a second opening located around the rotational axis of the impeller, wherein said second impeller base includes an outer end face;

a hub portion positioned along the rotational axis of the impeller and disposed between said first impeller base and said second impeller base; and vanes extending from said hub portion between said first impeller base and said second impeller base, wherein cavities are formed between said first impeller base and said second impeller base and between adjacent said vanes, said vanes including a first vane wall section extending from said hub portion to said first impeller base and a second vane wall section extending from said hub portion to said second impeller base;

wherein said first vane wall section includes a plurality of first inlet openings communicating said first opening with said cavities, and said second vane wall section includes a plurality of second inlet openings communicating said second opening with said cavities.

* * * * *